US005993080A

United States Patent [19]

Clough

[11] Patent Number: 5,993,080

[45] Date of Patent: Nov. 30, 1999

[54] SYSTEM FOR OPTICAL DRY PROCESSING OF SPOOLED PHOTOGRAPHIC FILM

[75] Inventor: Arthur H. Clough, Hardwick, Mass.

[73] Assignee: Polaroid Corporation, Cambridge, Mass.

[21] Appl. No.: 09/038,411

[22] Filed: Mar. 11, 1998

Related U.S. Application Data

[60] Provisional application No. 60/040,388, Mar. 11, 1997.

[51] Int. Cl.[6] ..... G03D 5/00; G03D 5/06

[52] U.S. Cl. ..... 396/604; 396/606

[58] Field of Search ..... 396/33, 575, 604, 396/606, 623, 647, 646, 648; 355/27–29, 406

[56] References Cited

U.S. PATENT DOCUMENTS

| | | | |
|---|---|---|---|
| 2,558,857 | 7/1951 | Land | 396/33 |
| 2,848,931 | 8/1958 | Troidl | 396/575 |
| 3,345,165 | 10/1967 | Land | 430/404 |
| 3,380,679 | 4/1968 | Komas et al. | 242/422 |
| 3,416,921 | 12/1968 | Coenen | 430/206 |
| 3,576,632 | 4/1971 | Bornmisza | 430/404 |
| 3,615,482 | 10/1971 | Cronig | 430/456 |
| 3,647,464 | 3/1972 | Smith | 430/232 |
| 3,680,462 | 8/1972 | Cronig | 396/606 |
| 3,681,254 | 8/1972 | Becker | 430/404 |
| 3,689,272 | 9/1972 | Schwan et al. | 430/206 |
| 3,816,136 | 6/1974 | Goffe et al. | 430/405 |
| 3,826,653 | 7/1974 | Jacobs et al. | 430/206 |
| 3,907,563 | 9/1975 | Land | 430/206 |
| 3,930,859 | 1/1976 | Corrigan | 430/404 |
| 4,309,100 | 1/1982 | Bendoni et al. | 396/604 |
| 4,370,045 | 1/1983 | Holmes | 396/585 |
| 4,452,523 | 6/1984 | Douglas | 396/33 |
| 4,605,608 | 8/1986 | Bullitt | 430/206 |
| 5,200,295 | 4/1993 | Vermeulen et al. | 430/206 |
| 5,229,246 | 7/1993 | Shibata et al. | 430/217 |
| 5,325,144 | 6/1994 | Yoshikawa et al. | 396/646 |
| 5,440,366 | 8/1995 | Reiss et al. | 396/33 |
| 5,473,402 | 12/1995 | Long et al. | 396/620 |
| 5,478,703 | 12/1995 | Simons | 430/383 |

FOREIGN PATENT DOCUMENTS 0 800 114 A2 10/1997 European Pat. Off. .

*Primary Examiner*—D. Rutledge
*Attorney, Agent, or Firm*—Leslie Payne

[57] ABSTRACT

A light-tight, temperature controlled system, controlled by a controller, for processing a photographic film housed in a film cartridge detachably secured upon a spool caddy having a plurality of processing spools mounted thereon, includes: means for rotating a spiral shaped wall about a rotational axis, the spool caddy being detachably mounted upon the rotating means in a predetermined positional alignment; means for combining an emulsion side of the film with processing webs from the processing spools along the spiral shaped wall for preset dwell times by sequentially in a preset order removing and replacing each of the processing spools and the film cartridge from and to the spool caddy, unwinding and rewinding the processing webs from and to the processing spools, and unwinding and rewinding the film from and to the film cartridge; and means for securing the processing spools and the film cartridge along a channel formed by the spiral shaped wall while the emulsion side of the film is being sequentially combined with the processing webs.

6 Claims, 20 Drawing Sheets

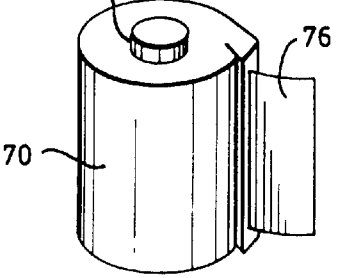
FIG. 7A
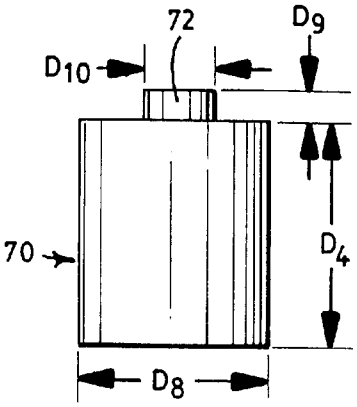
FIG. 7B
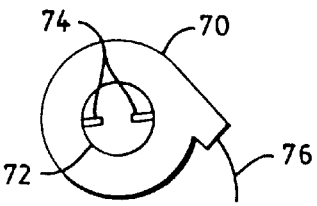
FIG. 7C
FIG. 8A
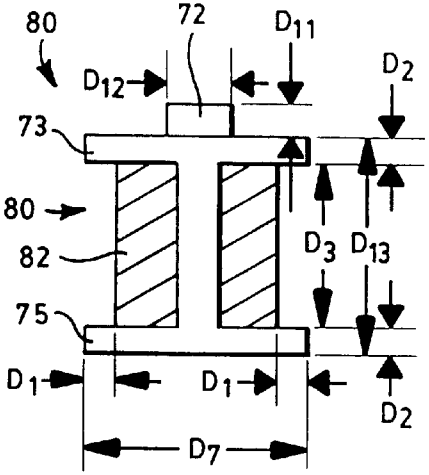
FIG. 8B
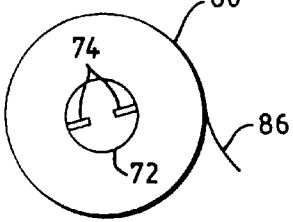
FIG. 8C

SYSTEM FOR OPTICAL DRY PROCESSING OF SPOOLED PHOTOGRAPHIC FILM

CROSS-REFERENCE TO RELATED APPLICATIONS

This application claims the benefit of United States provisional application Ser. No. 60/040,388 entitled "System For Optical Dry Processing of Spooled Photographic Film" filed on Mar. 11, 1997.

BACKGROUND OF THE INVENTION

1. Field of the Invention

This invention is directed generally towards a system and method for pad processing a spooled photographic film, and more specifically towards a system and method for processing a spooled photographic film using processing webs from a multitude of processing spools which are housed in a spool caddy as disclosed in Polaroid case no. 8222, entitled "Spool Caddy For Use With Dry Optical Image Processing of Roll Film", having United States provisional application Ser. No. 60/040,662 filed on Mar. 11, 1997 and also filed as an utility patent application on even date herewith, the latter being incorporated herein by reference.

2. Description of the Prior Art

Pad processing is a well known dry optical image processing technique for processing a photographic film using webs, also known as pads, which contain processing fluids. Pad processing is considered a dry processing technique since liquid chemical baths are replaced with reagent laden webs which have been imbibed with processing chemicals. Sometimes a pad is saturated with processing chemicals and at other times, the processing chemicals are stored in a rupturable pod. When the pod is ruptured, the processing chemicals are spread across the web as a first step towards film development. Many variations of pad processing have been exercised over the years although typically a singular processing web, i.e. a monopad, is combined with the emulsion side of a film for film development. However, in order to process a film using a monopad, both the film structure and the processing chemicals within the monopad become very complicated in order to accommodate the numerous varied processing steps such as developing, fixing and bleaching.

In U.S. Pat. No. 5,440,366 issued Aug. 8, 1995 to Reiss and Cocco, a system and method are disclosed whereby individual processing pads are sequentially wrapped onto a single processing spool. One embodiment discloses a processing spool which houses all the processing webs such as: a first reagent laden web which could be imbibed, for instance, with developing chemicals; a second reagent laden web which could be imbibed, for instance, with bleaching and fixing chemicals; and a third reagent laden web which could be imbibed, for instance, with washing and stabilizing chemicals. A photographic film is housed in a separate standard 35 mm cartridge. The first web is combined with the film for a first preset time, then the first web and the film are separated and the second web and the film are combined for a second preset time, then the second web and the film are separated and the third web and the film are combined for a third preset time. After the third web and the film are separated, the optical processing of the photographic film is complete. However, the standard size 35 mm cartridge limits the number of exposures available from such a combined web/film spool. If the cartridge was made larger to hold more exposures, then it would not fit into a standard 35 mm camera. Also, the above film processing system requires a tandem of processing webs separated from one another by foil but housed on a single spool. Many significant problems arise in housing all processing pads on a single spool and attempting to keep the various processing pads isolated from one another before and during processing.

The above and other disadvantages of existing processing systems are overcome by the systems and methods disclosed hereinafter in keeping with the principles of the present invention.

SUMMARY OF THE INVENTION

A light-tight, temperature controlled system, controlled by a controller, for processing a photographic film housed in a film cartridge detachably secured upon a spool caddy having a plurality of processing spools mounted thereon, includes: means for rotating a spiral shaped wall about a rotational axis, the spool caddy being detachably mounted upon the rotating means in a predetermined positional alignment; means for combining an emulsion side of the film with processing webs from the processing spools along the spiral shaped wall for preset dwell times by sequentially in a preset order removing and replacing each of the processing spools and the film cartridge from and to the spool caddy, unwinding and rewinding the processing webs from and to the processing spools, and unwinding and rewinding the film from and to the film cartridge; and means for securing the processing spools and the film cartridge along a channel formed by the spiral shaped wall while the emulsion side of the film is being sequentially combined with the processing webs.

BRIEF DESCRIPTION OF THE DRAWINGS

The aforementioned aspects and other features of the invention are described in detail in conjunction with the accompanying drawings in which the same reference numerals are used throughout for denoting corresponding elements and wherein:

FIG. 7A is a perspective view of a photographic film cartridge to be processed by the pad processing system of FIGS. 1A–1G;

FIG. 7B is a side view of the photographic film cartridge of FIG. 7A;

FIG. 7C is a top view of the photographic film cartridge of FIG. 7A;

FIG. 8A is a perspective view of a processing spool for use with the pad processing system of FIGS. 1A–1G;

FIG. 8B is a cross-sectional side cutout view of the processing spool of FIG. 8A;

FIG. 8C is a top view of the processing spool of FIG. 8A;

DETAILED DESCRIPTION OF THE PREFERRED EMBODIMENTS

Figure 1A:
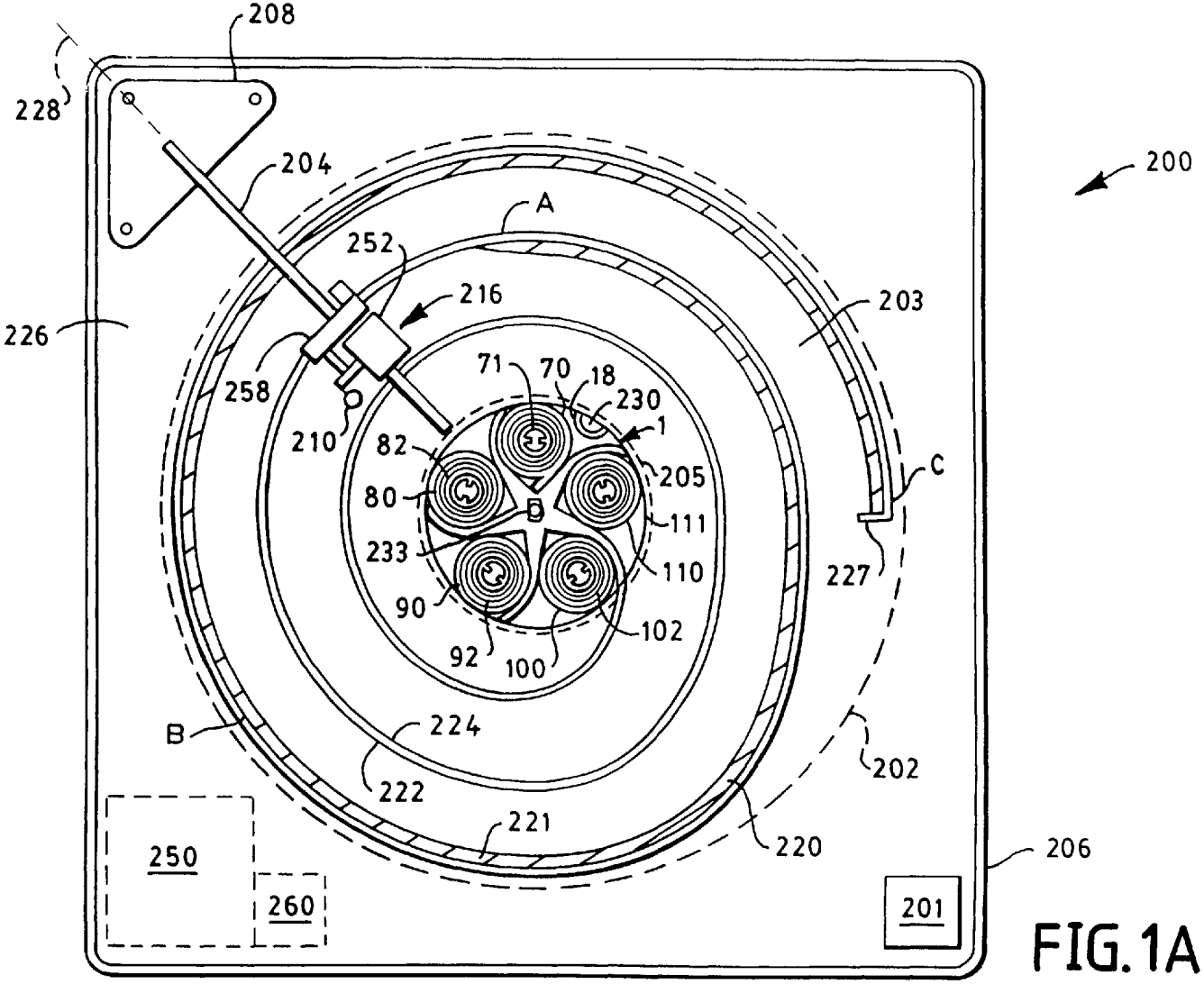
FIGS. 1A–1G illustrate a first embodiment of a pad processing system, built in accordance with the principles of the invention, at various stages of operation.

One preferred embodiment of a dry optical pad processing system built in accordance with the principles of the invention is shown in FIG. 1A. The processing system 200 utilizes a spool caddy 1 as disclosed in Polaroid case no. 8222 as referenced hereinabove for retaining and supporting a film cartridge and a multitude of processing spools.

The Spool Caddy

Figure 2:
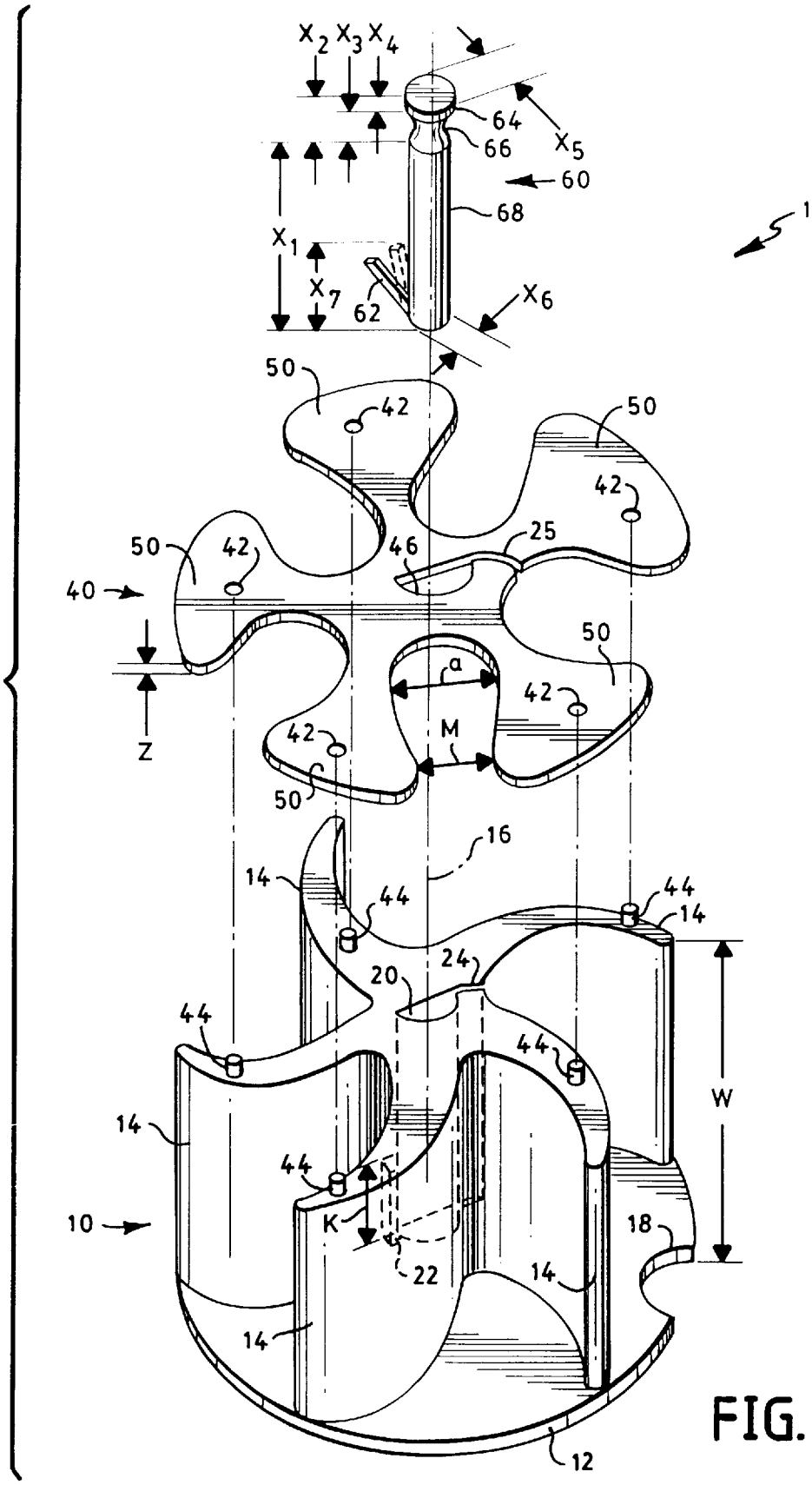
FIG. 2 is a perspective exploded view of one type of spool caddy for use with the pad processing system of FIGS. 1A–1G.

FIG. 2 is a perspective exploded view of one type of spool caddy 1. The three major components of the spool caddy 1 are the body 10, the snap plate 40 and the binding lever 60. Each of the major components is preferably molded or otherwise made from a strong, inexpensive, lightweight material such as polystyrene or any other plastic. These components when assembled together form the spool caddy 1, shown with a single processing spool 80 in FIG. 3.

Figure 3:
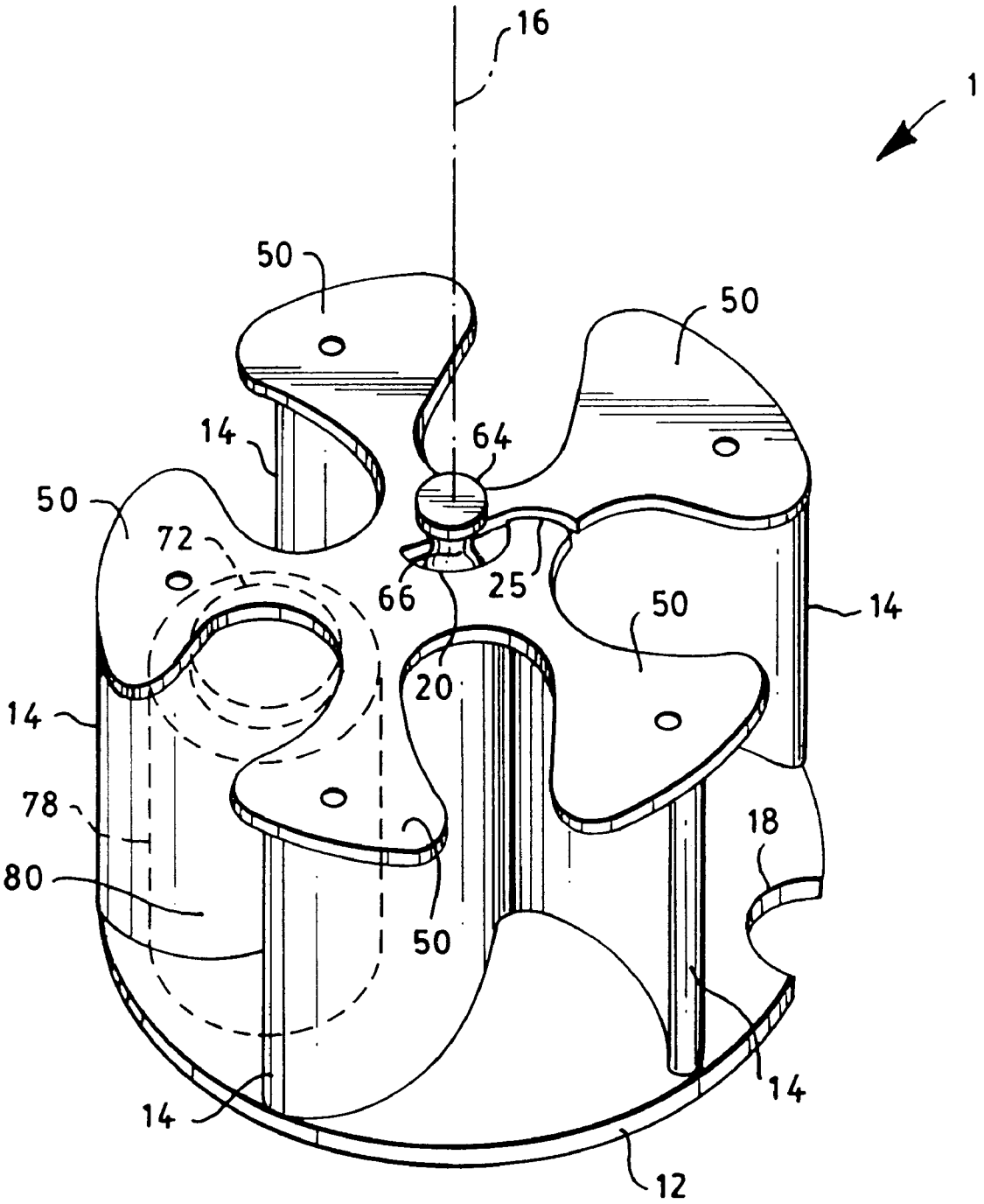
FIG. 3 is a perspective view of the assembled spool caddy of FIG. 2 with a single processing spool installed.
Figure 4A:
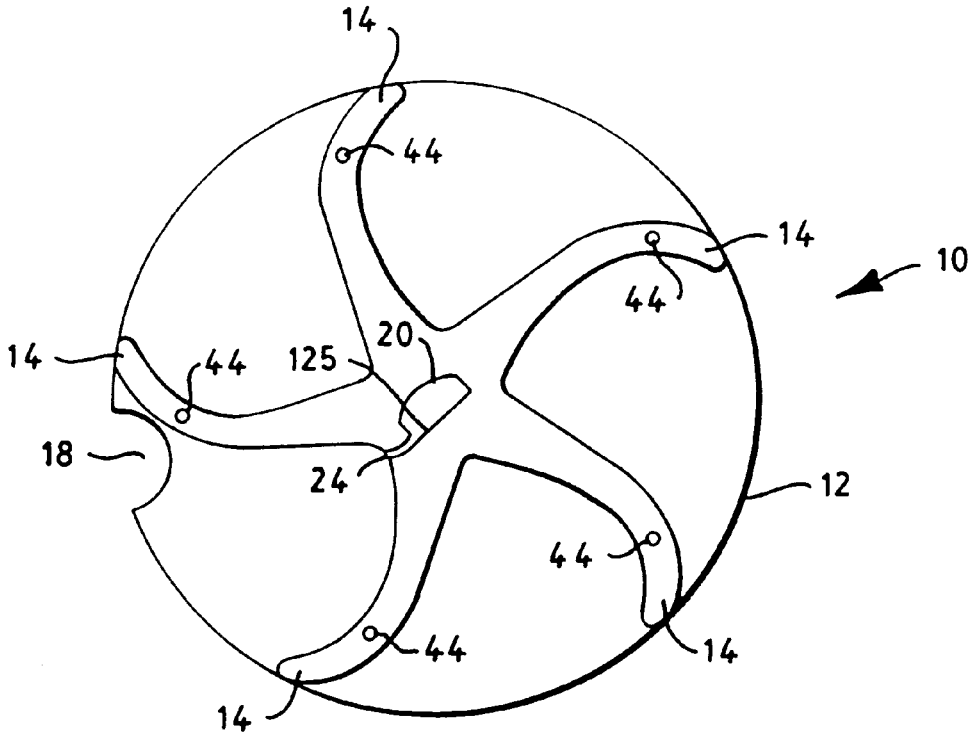
FIG. 4A is a top view of the body of the spool caddy of FIG. 2.
Figure 4C:
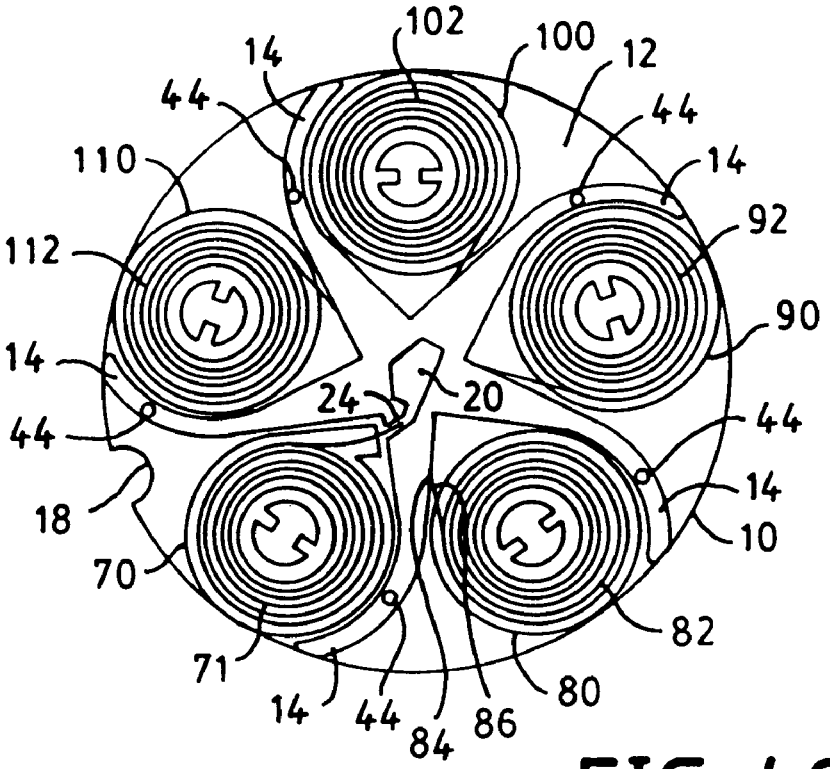
FIG. 4C is a top view of the body of the spool caddy of FIG. 2 having both processing spools and a photographic roll film cartridge supported thereon.

The body 10 acts as means, as shown in FIG. 4C, for detachably securing and supporting a number of processing spools 80, 90, 100 and 110 as well as the film cartridge 70, in isolation from one another. The body 10 includes a base 12, a plurality of arms 14 and a wedge shaped cavity 20 centered along the central longitudinal axis 16 of the spool caddy 1. The cavity 20 is indexed, notched or keyed in a lower section of the body by a rectangular notch 22. Moreover, a slot 24 for engaging a film leader 76 of the film cartridge 70 (see FIGS. 4C and 7A) extends from the cavity 20 as shown. The body 10 also includes a notch 18, as shown in FIG. 3, acting as a means for enabling positional alignment of the spool caddy 1 in relation to other components of a pad processing system.

The snap plate 40, having a thickness "z", includes a centrally located cavity shaped opening 46 similar in shape to the cavity 20 of the body 10, as well as a slot 25 corresponding to the slot 24 of the body 10. The snap plate 40 functions as means for detachably retaining or holding both a plurality of processing spools, such as the processing spool 80 of FIG. 3, and the film cartridge 70 of FIG. 7A. The snap plate 40 may be clover shaped as shown in FIG. 2, or its shape could vary as shown by the snap plate 140 of FIG. 5, as long as it has the ability to detachably retain processing spools and film cartridges. The snap plates 40 and 140 are both capable of detachably holding five spools, although the snap plates could be designed in cooperation with the spool caddy 1 to retain more or less spools if desired. The snap plate 40 of FIG. 2 includes five identical leaf shaped sections 50 defining five identical spaces therebetween, each space having a cross-sectional distance "a", and a narrow region of distance "m" at the perimeter of the snap plate 40. Similarly, the snap plate 140 of FIG. 5 includes five claw shaped arms 45 each having a pair of claws 49 and 51 which also define five identical spaces therebetween each having the same cross-sectional distance "a" and "m", respectively. The snap plate 40 or 140 and the body 10 can be glued together, snapped together, screwed together, or otherwise held together by any known fastening means. The spool caddy 1 of FIG. 2 provides clearance holes 42 in the snap plate 40 and raised bosses 44 on the body 10 which allows the two parts to be joined together by ultrasonic staking to form the body/snap plate assembly. The snap plate 140 of FIG. 5 includes clearance holes 43 which would be aligned with appropriately positioned raised bosses (not shown) replacing the bosses 44 on the body 10.

Figure 5:
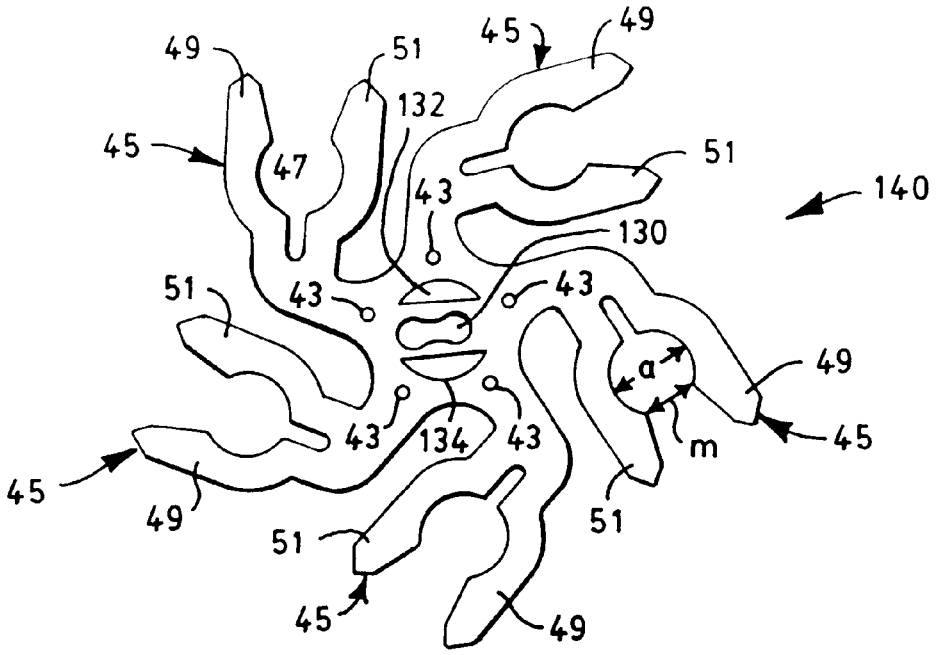
FIG. 5 illustrates an alternative snap plate for use with the spool caddy of FIG. 2.
Figure 6C:
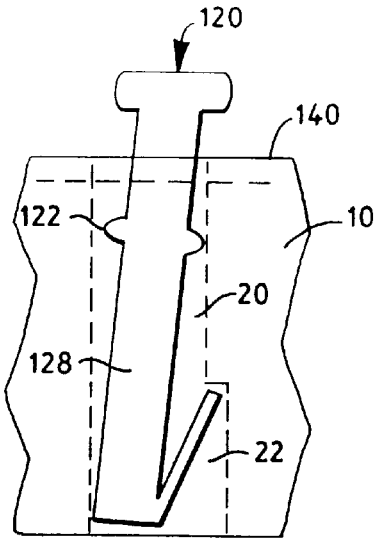
FIG. 6C is a schematical cross-sectional view of the binding lever of FIG. 6A in the unlocked position as installed in the spool caddy of FIG. 2.
Figure 6D:
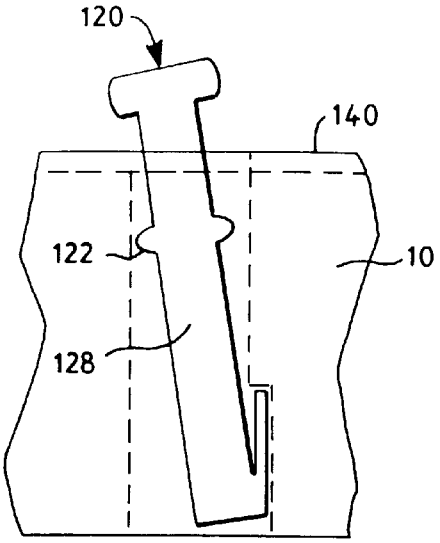
FIG. 6D is a schematical cross-sectional view of the binding lever of FIG. 5A in the locked position as installed in the spool caddy of FIG. 2.
Figure 6A:
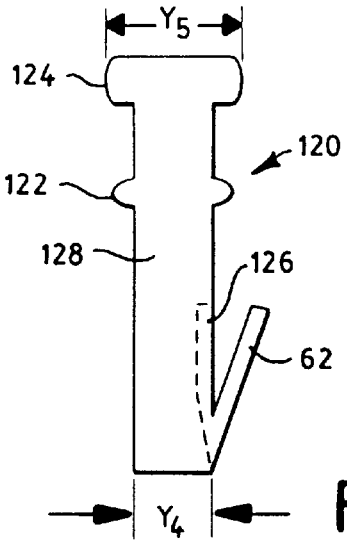
FIG. 6A illustrates an alternative binding lever for use with the spool caddy of FIG. 2 in conjunction with the snap plate of FIG. 5.
Figure 6B:
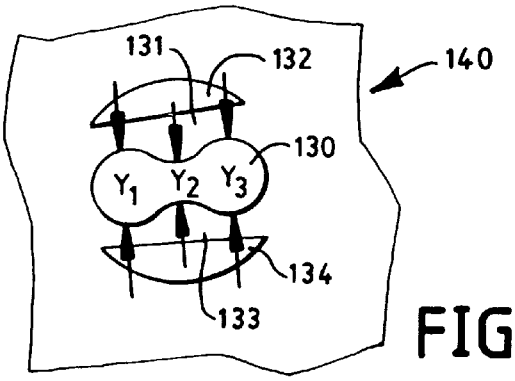
FIG. 6B is a magnified top view of a centrally located section of the snap plate of FIG. 5.

The snap plate 140 also includes centrally located cutouts 130, 132 and 134 as illustrated in FIGS. 5 and 6B. The cutout 130 is an hour glass shaped opening defined by distances $y_1$, $y_2$ and $y_3$, where $y_1=y_3=y_4$, $y_4<y_1$ and $y_4>y_2$ (see also FIG. 6A). Cutout 134 is separated from the cutout 130 by a section 133, and cutout 132 is separated from the cutout 130 by a section 131.

The binding lever 60 is designed as a means for detachably retaining, in cooperation with the body 10, a film leader 76 of the film 71. First, the film leader 76 is inserted into the cavity 20 of the caddy body 10, then the binding lever 60 is inserted through the top of the body/snap plate assembly so that the spring 62 is aligned with, and snaps into, the notch 22. The diameter $x_5$ of the head 64 of the binding lever 60 is large enough so that the head 64 can not pass into or through the cavity 20. Also, the force of the spring 62 pushes the spring 62 against the internal wall of the notch 22 to securely bind the lever 60 in the cavity 20. Hence, once the binding lever 60 is inserted into the cavity 20 it cannot be removed. After insertion of the binding lever 60, the head 64 and the indent 66 of the binding lever 60 will both protrude above the snap plate 40 as shown in FIG. 3 to act in cooperation as a handle for inserting and removing the spool caddy 1 from a pad processing system.

The binding lever 60 of FIG. 2 includes: a shaft 68 of diameter $x_6$ and height $x_1$; an indent 66 of length $x_3$; a head 64 having a diameter $x_5$ and a thickness $x_4$; and a spring 62 of length $x_7$ having a spring force which tends to extend the spring 62 away from the shaft 68 as shown. When a force is applied to the spring 62 to bring it nearly parallel with the longitudinal axis 16 of the shaft 68 (shown by dotted lines), the length $x_7$ defines the distance from the bottom of the shaft 68 to the top end of the spring 62. The length $x_7$ also corresponds to the length "k" of the notch 22 located adjacent to the lower portion of the cavity 20 in the caddy body 10. The distance $x_1$ of the shaft 68 of the binding lever 60 equates to the sum of the height "w" of the caddy body 10 and the width "z" of the snap plate 40 so that when the spool caddy 1 is completely assembled as shown in FIG. 3, the shaft head 64 and the indent 66 both protrude above the snap plate 40.

Once the spool caddy 1 is assembled as shown in FIG. 3, any movement of the binding lever 60 in a direction crossing the central longitudinal axis 16 of the spool caddy 1 is hampered by the force of the spring 62. Furthermore, any movement of the binding lever 60 in a direction parallel to the longitudinal axis 16 is hampered by both the head 64 and the physical engagement of the spring 62 within the notch 22.

Figure 4B:
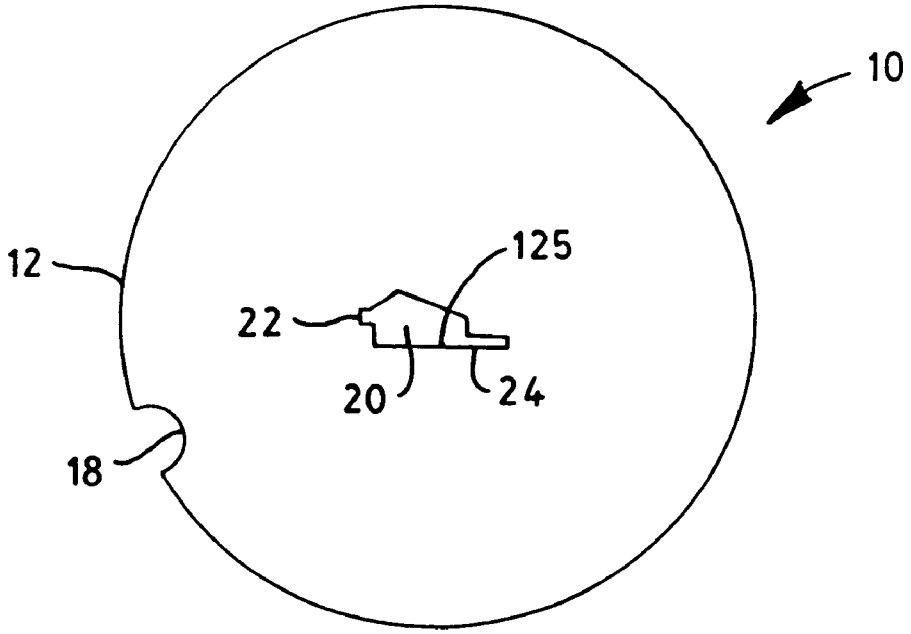
FIG. 4B is a bottom view of the body of the spool caddy of FIG. 2.

When the user decides to process the film within a 35 mm film cartridge 70 using a spool caddy 1 having a snap plate 40 and a binding lever 60, he first feeds the film leader 76 into the slot 24 of the caddy body 10 and along the flat surface 125 of the cavity 20 (see FIGS. 3, 4B and 4C). Next, the binding lever 60 is inserted as described above so that the spring 62 snaps into the notch 22 and the film leader 76 becomes bound between the shaft 68 and the flat surface 125 in the cavity 20. The film cartridge 70 is then detachably secured onto the spool caddy 1 by snapping the core 72 of the film cartridge 70 into the clover leaf shaped snap plate 40. In order to release the film leader 76, the user laterally applies pressure to the head 64 of the binding lever 60 so that the shaft 68 moves slightly away from the flat surface 125.

A second type of binding lever 120 for use with the snap plate 140 of FIG. 5 is shown in side view in FIG. 6A. The binding lever 120 includes a shaft 128 having a cutout section 126. The shaft 128 has a diameter $y_4$, and further includes an annular rib 122 having a diameter greater than $y_4$. The binding lever 120 is designed to operate in cooperation with the cutout section 130 of the snap plate 140 (see FIGS. 5 and 6B). The binding lever 120 is placed in an initial unlocked position as shown in FIG. 6C by inserting lever 120 through $y_3$ of the cutout 130 and into the body/snap plate assembly from the top until the spring 62 snaps into place within the notch 22.

When the user decides to process the film within a 35 mm film cartridge 70 using a spool caddy 1 having a snap plate 140, first, he feeds the film leader 76 into the slot 24 of the caddy body 10 and into engagement with the flat surface 125 in the cavity 20. Then, he inserts the binding lever 120 into the unlocked position of FIG. 6C so that the film leader 76 is loosely positioned in the cavity 20 between the flat surface 125 and the shaft 128. The user then applies a lateral force to the head 124 of the binding lever 120 so that the binding lever 120 is shifted and snapped into the locked position shown in FIG. 6D, whereby the film leader 76 is securely fastened in the cavity 20 between the flat surface 125 and the shaft 128. When pushing the binding lever 120 into the locked position, the binding lever 120 passes from $y_3$ (see FIG. 6B) through the region $y_2$ of the cutout 130 and into the locked position of FIG. 5D corresponding to the region $y_1$ of the cutout 130. When the binding lever 120 passes through the region $y_2$ of the cutout 130, the sections 131 and 133 will slightly bend away from the cutout 130 and into the respective cutouts 132 and 134, thus momentarily expanding the distance $y_2$ to allow passage of the binding lever shaft 128. After passage of the binding lever 60, the sections 131 and 133 resiliently return to their original positions. The resultant locked position of the binding lever 120 is illustrated in FIG. 6D whereby the annular rib 122 is bound upon the inner surface 125 of the cavity 20 with the film leader 76 secured therebetween (not shown). Once the film leader 76 is secured within the cavity 20, the film cartridge 70 can be detachably secured onto the spool caddy 1 by snapping the core 72 of the film cartridge 70 between two claws 49 and 51 of the snap plate 140.

The film leader 76 can be readily removed from the binding lever 120 by moving the binding lever 120 into its unlocked or release position. This is accomplished by pushing the head 124 of the binding lever 120 from $y_1$ through $y_2$ and into $y_3$, as viewed in FIG. 6B, whereby the film leader 76 is then loosely positioned between the annular rib 122 of the shaft 128 and the flat surface 125 to facilitate removal therefrom.

The processing spools 80, 90, 100 and 110 are each factory installed into the spool caddy 1 in the same manner in which processing spool 80 is shown to be installed in FIG. 3. Each processing spool as well as a standard 35 mm film cartridge 70 contains a hollow core 72 with dual drive tangs 74 recessed therein (see FIGS. 7C and 8C) for transferring rotational drive force from a source (such as the spool drive motor 270 in FIG. 10D) to the spool or cartridge through its respective core 72.

The structure and dimensions of each processing spool 80, 90, 100 and 110 is similar to that shown in FIGS. 8A, 8B and 8C. FIG. 7B illustrates a typical 35 mm film cartridge 70 having a height $D_4$ and a diameter $D_8$. The cartridge 70 includes a core 72 having a diameter $D_{10}$ and a height $D_9$ which protrudes from the main body of the film cartridge 70. FIG. 8B illustrates a developer processing spool 80 having a height $D_{13}$ and a diameter $D_7$. The spool 80 includes a core 72 having a diameter $D_{12}$ and a height $D_{11}$ which protrudes from the main body of the spool 80. The processing spool 80 also includes upper and lower flanges 73 and 75, respectively, each having a thickness $D_2$. FIG. 8B further illustrates a partially unwound spool 80 whereby the developer web 82 has been unwound by a distance $D_1$ from the outer edges, i.e. the circumference, of the equal sized flanges 73 and 75. The various dimensions of the film cartridge 70 and the processing spool 80 are related as follows: $D_{10}=D_{12}$; $D_9=D_{11}$; $D_4=D_{13}$; $D_7>D_8$; and $D_{13}=D_3+2D_2$. If a film cartridge has less than 24 exposures, then $D_7 \geqq D_8$.

The spool caddy 1 is designed to accommodate any 35 mm film cartridge or processing spool by snapping the core 72 through the appropriate narrow region "m" of the snap plates 40 or 140 and into the space having a cross-sectional distance "a" as shown in FIGS. 2 and 5, whereby $a=D_{10}=D_{12}$ and $m<a$. Since the length and thickness of the webs within the processing spools may likely be greater than the length and thickness of the image carrying medium within the film cartridge 70, then the diameter $D_7$ of the processing spools may likely be greater than the diameter $D_8$ of a standard size 35 mm film cartridge. Thus, the spool caddy 1 is built to accommodate spools having various diameters. Moreover, the snap plates 40 and 140 are made of a flexible, resilient plastic which allows resilient spreading of the leaf sections 50 in the snap plate 40 and the claws 49 and 51 in the snap plate 140 during insertion or removal of the core 72 of a spool or cartridge. Once a processing spool or a film cartridge is snapped into place in the spool caddy 1 as shown in FIG. 3, it is held there until a force is applied to remove the core 72 through the gap "m". The force required for inserting or removing the core 72 from either snap plate 40 or 140 is adjustable by changing the material from which the snap plate 40 or 140 is made, changing the thickness "z" of the snap plate 40 or 140, or by adjusting the length and width of a channel 47 for each arm 45 of the snap plate 140.

Each processing spool contains a web having a protruding leader which is fixedly attached to one arm 14 of the caddy body 10 as shown in FIG. 4C. For example, the web 82 of spool 80 is shown to have a protruding leader 86 which is fixedly attached to one arm 14 at point 84. Spool 80 is a developer spool which contains a reagent laden web imbibed with developing chemicals; spool 90 is a blix (i.e. bleaching and fixing) spool which contains a reagent laden web imbibed with a combination of bleaching and fixing chemicals; spool 100 is a wash spool which contains a web 102 soaked with a combination of washing and stabilizing agents; and spool 110 is a blotter spool which contains a dry non-woven material.

The assembled spool caddy 1 contains the body 10, the snap plate 40, the binding lever 60, and the preselected processing spools. The number and contents of the processing spools of a particular spool caddy can vary according to the needs for processing a particular roll film. For instance, if separate bleaching and fixing steps are desired, then the blix spool 90 could be replaced by two separate spools, one containing a reagent laden web imbibed with bleaching chemicals, and the other containing a reagent laden web imbibed with fixing chemicals. The spool caddy 1 would then require six arms 14 and the snap plate 40 would require six leaf shaped sections 50.

Of course, processing spools with other processing capabilities could be added to the spool caddy 1 if desired. The number of arms 14 on the caddy body 10 and the number of leaf shaped sections 50 on the snap plate 40, or claws 45 on the snap plate 140, can change in accordance with the number of spools desired or required for film processing. Moreover, the arms 14 can take any desired shape as long as they provide both support for the various spools, and isolation of those spools from one another. Also, any snap plate design may be used that allows the snap plate to detachably hold each spool in place. Furthermore, the processing spools could be encased in hard shell cartridges, similar to 35 m cartridges, so that a snap plate could detachably retain the bodies of the hard shell processing cartridges, rather than the cores as described above.

A modified version of the above-described spool caddy 1 would house only the processing spools, i.e. the modified spool caddy 1 would not house the film cartridge 70. In this embodiment, the structural components of the spool caddy 1 which interact solely with the film 71 or the film cartridge 70 become unnecessary. In other words, the binding lever 60, the slot 24 and the cavity 20 would no longer be needed.

Other embodiments of a spool caddy which can be used with the inventive pad processing system are described in Polaroid case No. 8222, entitled "Spool Caddy For Use With Dry Optical Image Processing of Roll Film", having United States provisional application Ser. No. 60/040,662 filed on Mar. 11, 1997 and also filed as an utility patent application on even date herewith, which is incorporated herein by reference in its entirety.

The functionality of the spool caddy 1 in cooperation with other elements of a pad processing system 200 according to the present invention is hereinafter described.

Structure of a Pad Processing System

The pad processing system 200 shown in FIG. 1A includes a housing 206, a heating unit 201 mounted within the housing 206, a turntable 202 fastened to the housing 206, and an overhead support structure which may be a bridge or, as illustrated, a support rail or cantilever 204 mounted onto a base assembly 208 which is, in turn, mounted upon a surface 226 of the housing 206. The turntable 202 includes a spiral shaped rib or wall 220 having an internal side 224 and an external side 222 with a foam rubber strip 221 adhesively bonded thereto between points A and C of the spiral. The turntable 202 also includes a caddy interface, for example, a recessed circular area 205 for accommodating the spool caddy 1. The circular area 205 has a slightly larger radius than the radius of the spool caddy 1, whereby the circular area 205 is recessed below the turntable surface 203 and centered at a rotational axis 233 of the turntable 202. Additionally, a protrusion 230 extends from the recessed circular area 205 for cooperation with a keyed notch 18 of the spool caddy 1 in order to keep the spool caddy 1 in a fixed position in relation to the turntable 202. Other known keying arrangements can be utilized as described, for instance, in Polaroid case No. 8222.

The turntable 202, as well known in the art, can be powered by a belt (not shown) and a motor 250, which is wired to and controlled by a controller 260, e.g. a servo controller. The motor 250 could be designed with a slip gear or pulley (not shown) which will harmlessly spin when a torque limit is reached while moving a spool or cartridge along the channel 203. As another option, a current limited locked rotor drive system could be used whereby the motor locks when its torque exceeds some preset limit.

The cantilever 204 is supported at one end by the base assembly 208 and, without further support, extends above the wall 220 to the vicinity of the spool caddy 1 (see FIG. 1A). The cantilever 204, preferably constructed from a beam of ⅜ inch square cross-sectional steel or some other strong durable material, acts as a support and guide for the spool retrieval mechanism 216 which will move back and forth along the cantilever 204 in accordance with a predetermined timing sequence dictated by the controller 260.

Figures 9A, 9B, 9C:
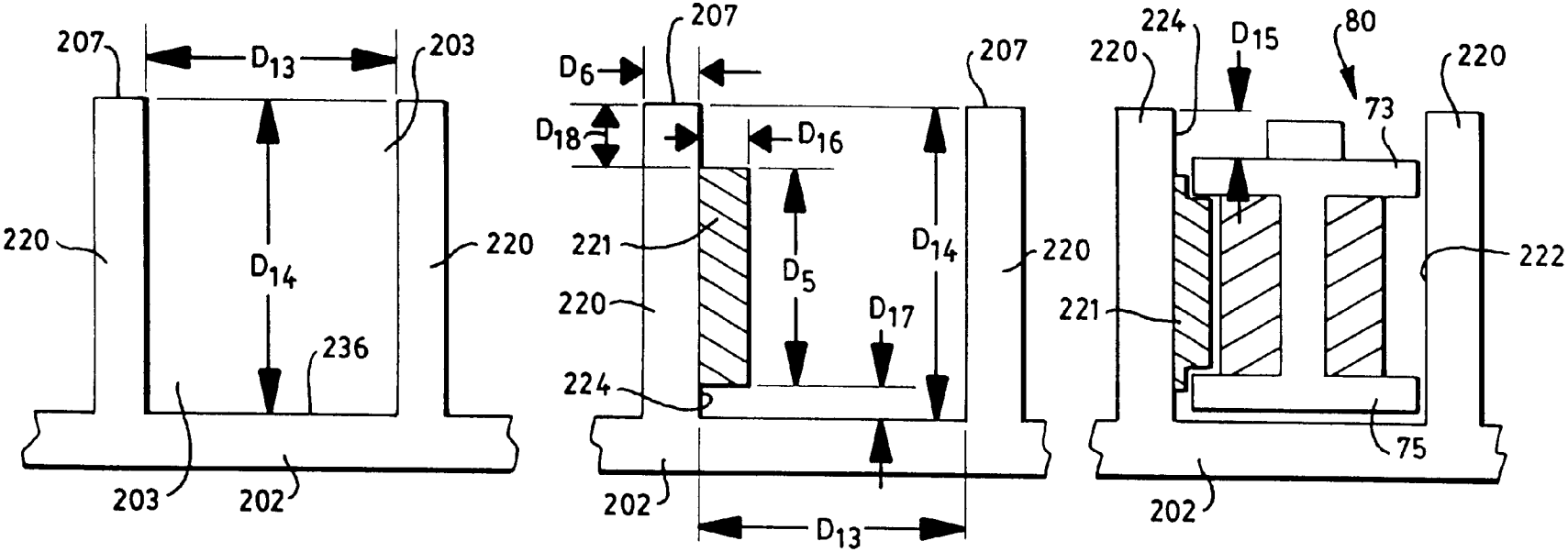
FIG. 9A is a cross-sectional side view of two adjacent spiral walls, without a braking mechanism, mounted on a turntable to form a channel through which a film cartridge or processing spool can travel during film processing.
FIG. 9B is a cross-sectional side view of two adjacent spiral walls, including a braking mechanism, mounted on a turntable to form a channel through which a film cartridge or processing spool can travel during film processing.
FIG. 9C is a cross-sectional side view of two adjacent spiral walls, including a braking mechanism, mounted on a turntable to form a channel through which a processing spool is traveling during film processing.
Figure 10D:
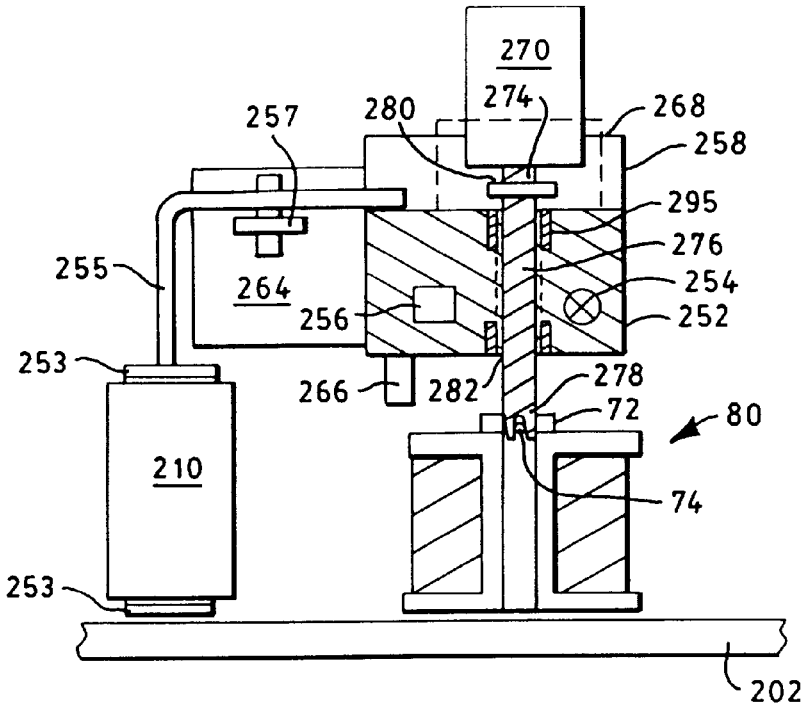
FIG. 10D is an end view of a spool retrieval mechanism used in the pad processing system of FIGS. 1A–1G.
Figure 10A:
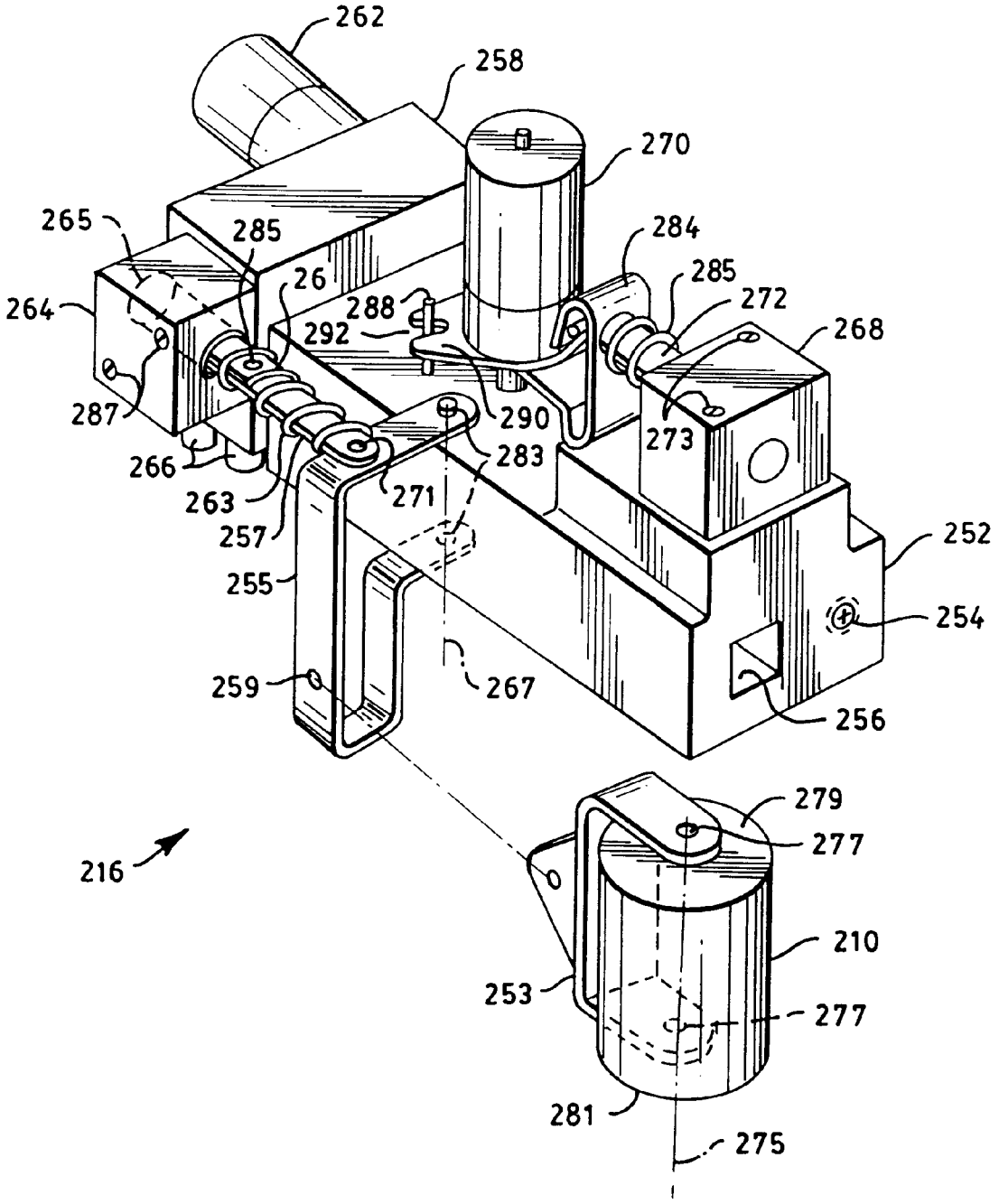
FIG. 10A is a perspective view of a spool retrieval mechanism used in the pad processing system of FIGS. 1A–1G.
Figure 10B:
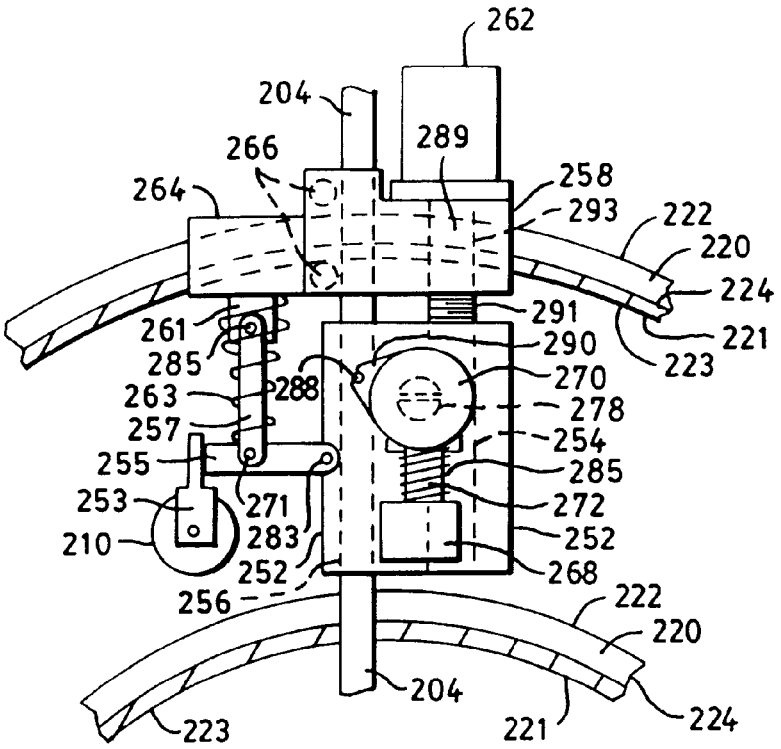
FIG. 10B is a top view of a spool retrieval mechanism used in the pad processing system of FIGS. 1A–1G.
Figure 10C:
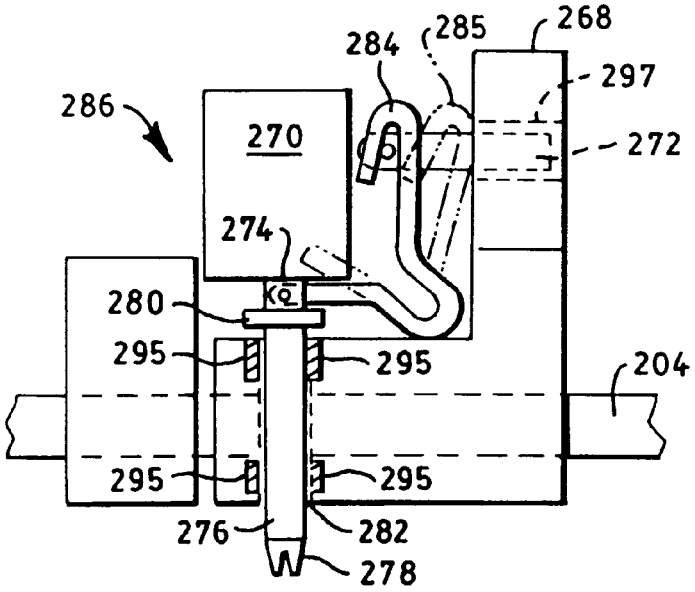
FIG. 10C is a left side view of a spool retrieval mechanism used in the pad processing system of FIGS. 1A–1G.

The spool retrieval mechanism 216 is shown from a perspective view in FIG. 10A, from a top view in FIG. 10B, from a left side view in FIG. 10C, and from an end view while engaging a spool in FIG. 10D. Movement of the spool retrieval mechanism 216 along the channel 203 is directed by the cam follower rollers 266 which are mounted on the bottom of the rear support block 258 and which continuously engage the top edge 207 of the wall 220 (see FIG. 9A) as the spool retrieval mechanism 216 moves back and forth along the cantilever 204. Together with the cantilever 204, the spool retrieval mechanism 216 forms a means for transporting and winding or unwinding a spool or cartridge along the channel 203. The spool retrieval mechanism 216 includes both a front support block 252 and a rear support block 258.

The front support block 252 of the spool retrieval mechanism 216 has therethrough both a threaded bore 254 and a smooth square bore 256. The square bore 256 accepts the cantilever 204 for supporting and guiding the mechanism 216, and the threaded bore 254 accepts a threaded screw 291 which is an extension of the shaft 289 of the screw drive motor 262. The screw drive motor shaft 289 passes through the bore 293 in the rear support block 258. Other components attached to the front block 252 include a spool rewind motor 270, a spindle retraction solenoid 268, and a linkage 255 connected to the front block 252 by a pair of pivotal connectors 283.

The rear support block 258 of the spool retrieval mechanism 216 has attached thereto: a spread roll solenoid 264 mounted to the block 258 by connectors 287; the screw drive motor 262; and a pair of cam follower rollers 266. The cam followers 266 are designed to extend below the rear support block 258 so that they engage and follow both the interior and exterior surfaces 224, 222 of the wall 220 along a section within a distance $D_{18}$ (see FIG. 9B) of the top edge 207 of the wall 220.

The spread roll solenoid 264 has a shaft 261 which moves in and out of a bore 265 and which is pivotally connected to one end of an extender 257 by a pivotal connector 285. The other end of the extender 257 is pivotally connected to the linkage 255 by a pivotal connector 271. The linkage 255 is further pivotally connected to a spread roller support 253 by a pivotal connector 259. A cylindrical, rubber covered spreading roller 210, having a central longitudinal axis 275, is mounted along the axis 275 to the support 253, for instance, by pins 277 which can snap into indents (not shown) that are machined into each end 279 and 281 of the spread roller 210.

When the spread roll solenoid 264 is activated by the controller 260, the shaft 261 is retracted so that the spreading roller 210, through the component set 257, 255 and 253, is retracted and disengaged from the external side 222 of the wall 220 as shown in FIG. 10B. Specifically, when the shaft 261 retracts into the bore 265 of the solenoid 264, the extender 257 is also drawn towards the solenoid 264 so that the linkage 255 moves in the direction of the solenoid 264 along a circular path centered by the axis 267 (FIG. 10A) which is created by joining the connectors 283 together with a straight line. In this manner, the spread roller 210 also moves in the direction of the solenoid 264 so that the roller 210 moves away from the external surface 222 of the wall 220 to which the roller 210 was engaged.

Figure 1B:
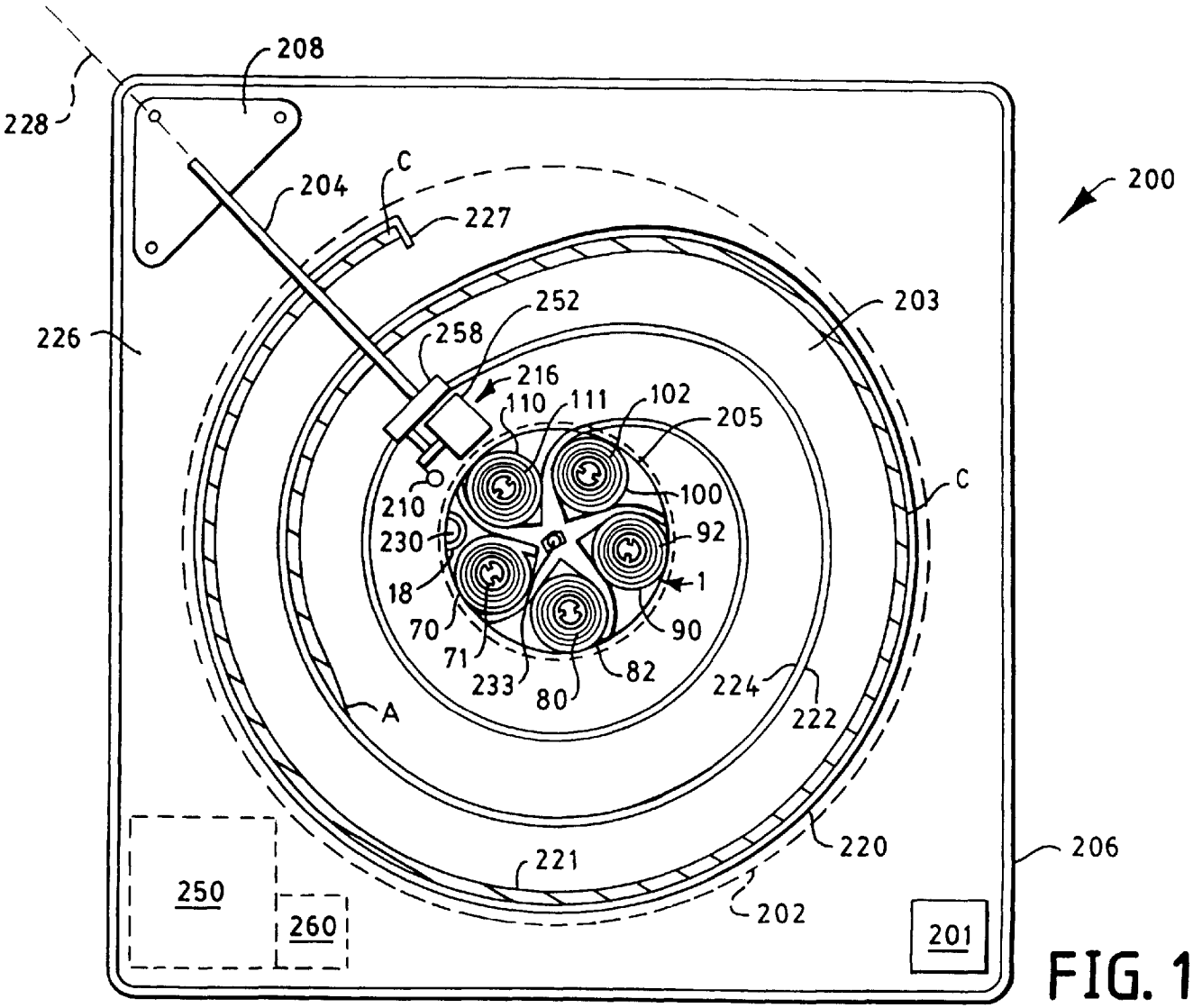
Figure 1C:
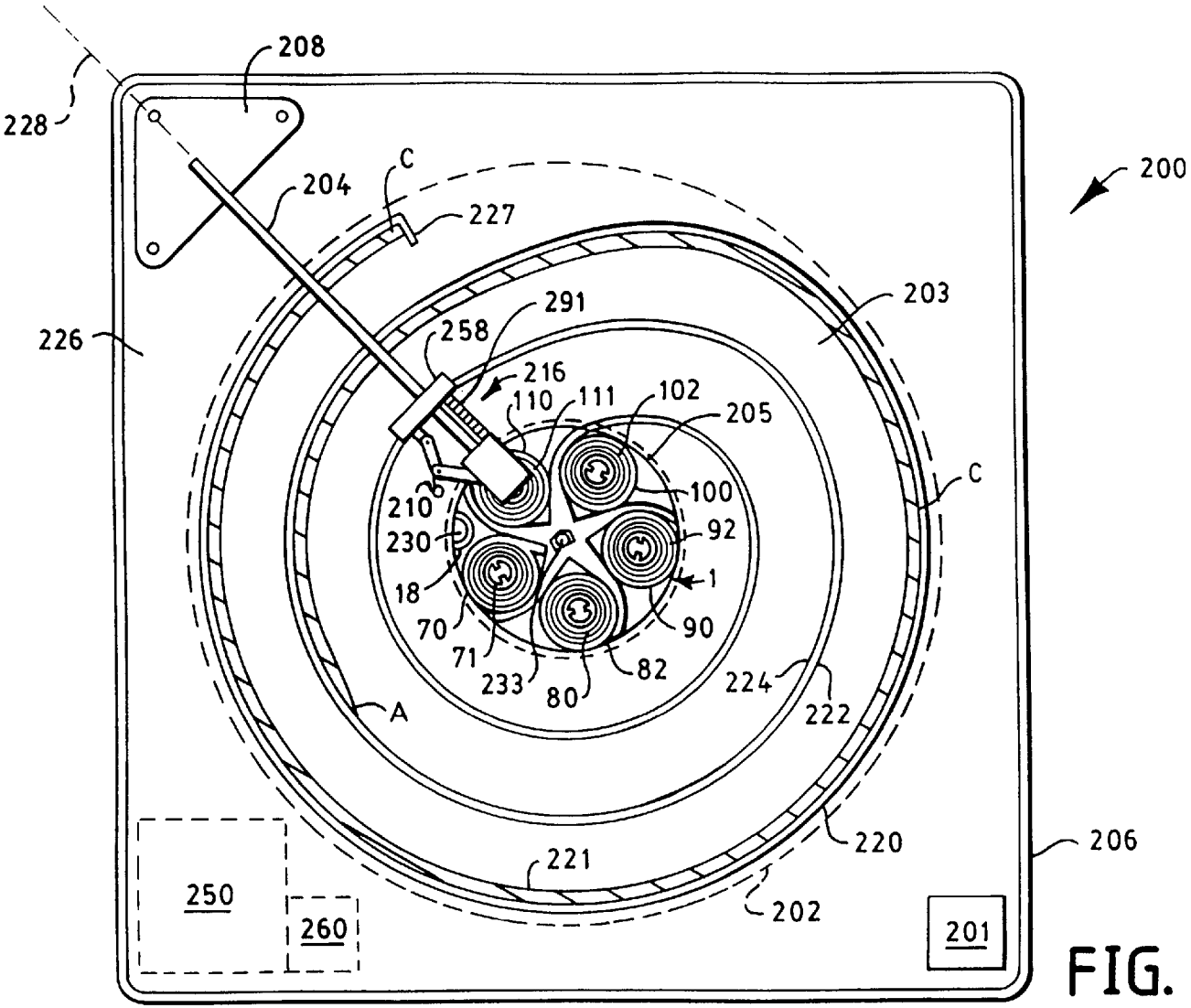
Figure 1D:
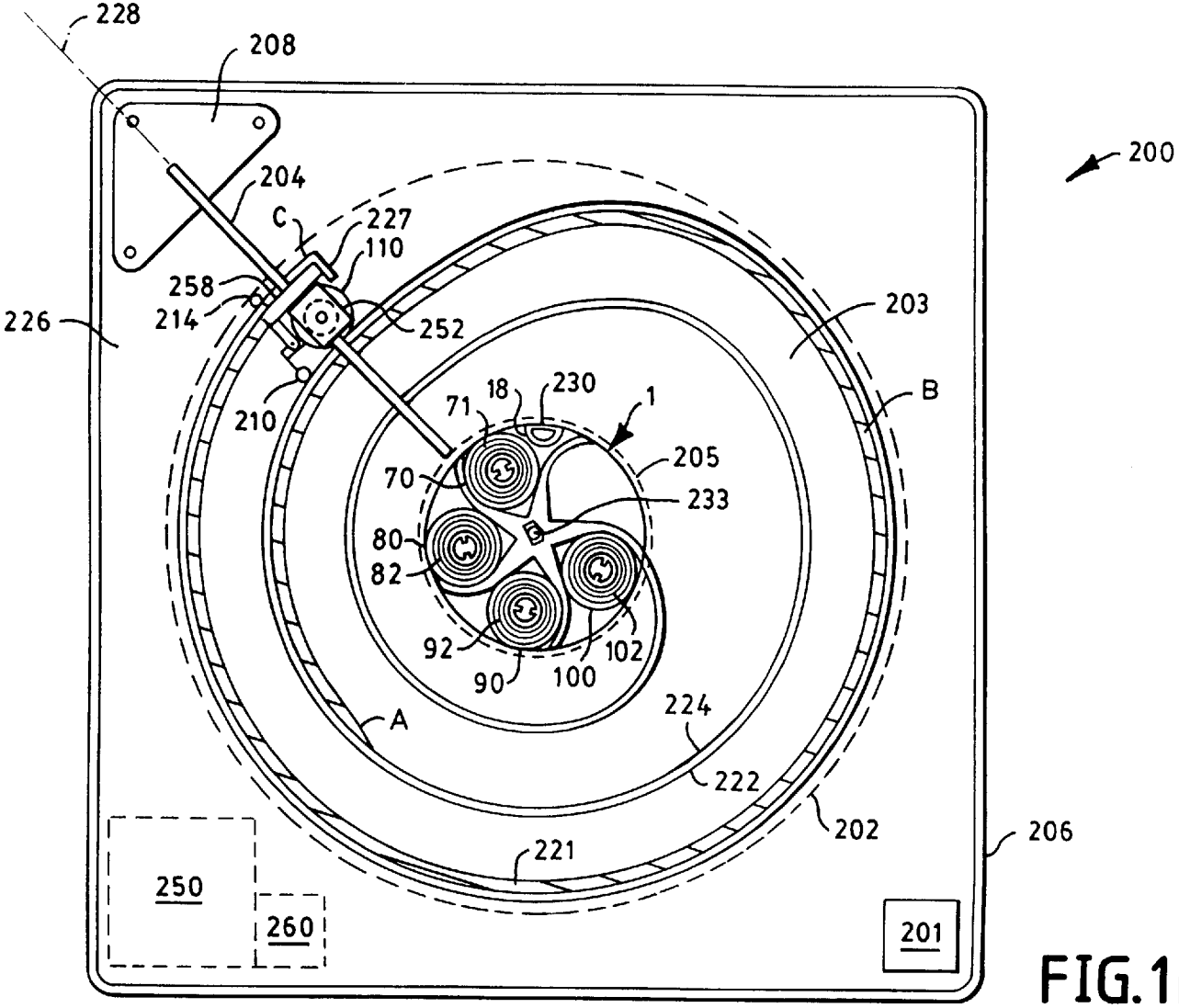

When the solenoid 264 is deactivated, the force of the spring 263 returns the shaft 261 to its extended position so that, through the component set 257, 255 and 253, the spreading roller 210 becomes engaged with the external side 222 of the wall 220 as shown for instance in FIG. 1D. Specifically, when the shaft 261 extends out of the bore 265 of the solenoid 264, the extender 257 is moved away from the solenoid 264 along a radial path centered by the axis 267. In this manner, the spread roller 210 is radially moved away from the solenoid 264 until the roller 210 becomes engaged with the external surface 222 of the wall 200 using a predetermined engagement force from the spring 263 (see FIG. 10A). Also when the solenoid 264 is deactivated, the pivotal movement of the spreading roller 210 and the support 253 about the pivotal connector 259 allows the roller 210 to accurately track the external surface 222 of the wall 220 through any irregularities so that the rubber cylindrical surface of the roller 210 remains in full contact with the external surface 222.

The front support block 252 can be moved in relation to the rear support block 258. The front and rear support blocks 252 and 258, respectively, are originally positioned adjacent to one another as shown in FIG. 10A, but the front support block 252 can be moved to an extended position as shown in FIG. 1C. The shaft 291 of the screw drive motor 262 engages with the threaded bore 254 of the front support block 252, thus enabling relative movement of the front support block 252 to the rear support block 258 upon activation of the screw drive motor 262.

With the front support block 252 in the extended position away from the rear support block 258, the screw drive motor 262 is activated in a reverse direction so that the front support block 252 will move towards the rear support block 258. In accordance with instructions from the controller 260, the screw drive motor 262 will function for a given time at a given rate in the reverse direction, causing the front support block 252 to move to a position adjacent to the rear support block 258.

When the front support block 252 is adjacent to the rear support block 258, the screw drive motor 262 can be activated in a forward direction to move the front support block 252 away from the rear support block 258. In accordance with instructions from the controller 260, the screw drive motor 262 will function for a given time at a given rate so that the front support block 252 will move a predetermined distance away from the rear support block 258. This distance will correspond with positioning the spindle 276 directly over the core 72 of a spool or cartridge housed in the spool caddy 1 (see FIG. 1C).

When the screw drive motor 262 is activated to position the front support block 252 over a spool or cartridge housed on the spool caddy 1, the intent is to secure the spool or cartridge so that it can moved along the channel 203 of the spiral wall 220 to unwind a web or film.

The spool rewind motor 270 has a shaft 274 which is inserted into and fixedly attached to a spool drive spindle 276 having a spindle head 278 connected at one end thereof The spool rewind motor 270 is activated for rewinding a spool or cartridge. When the spool rewind motor 270 is deactivated, the shaft 274 and the spindle 276 rotate freely. The spindle 276 contains a flange 280 and a spindle bore 282 having bearings 295 in the front support block 258. The flange 280 regulates the movement of the spindle 276 through the bore 282, and also allows transmission of spring force from the spring 285 when the spindle 276 is lowered into the core 72 of a spool. The spindle assembly 286, which includes the motor 270, the shaft 274 and the spindle 276, is linked to the shaft 272 of the spindle retraction solenoid 268 via a linkage 284. When the solenoid 268 is activated, the shaft 272 is retracted into the bore 297 of the solenoid 268, causing the linkage 284 (as shown by dotted lines in FIG. 10C) to be pulled towards the solenoid 268 which, in turn, causes the spindle assembly 286 to move to an upper position whereby the spindle head 278 retracts into the bore 282. At this point, the front support block 252 can be moved (without the spindle head 278 string the wall 220) to position the spindle 276 directly above the core 72 of a spool or cartridge housed in the spool caddy 1 as shown in FIG. 1C. When the spindle retraction solenoid 268 is deactivated, the spring 285 causes the shaft 272 to be extended out of the solenoid 268 so that the spool assembly 286 is moved, via linkage 284, to a lower position, causing the spindle head 278 to engage the tangs 74 of the spool core 72 as shown in FIG. 10D. Once the spindle head 278 is engaged with the tangs 74 of the spool core 72, the screw drive motor 262 is activated in the reverse direction to draw the front support block 252 adjacent to the rear support block 258. Then, the spool or cartridge can be moved along the channel 203 by rotational movement of the turntable 202.

Figure 12:
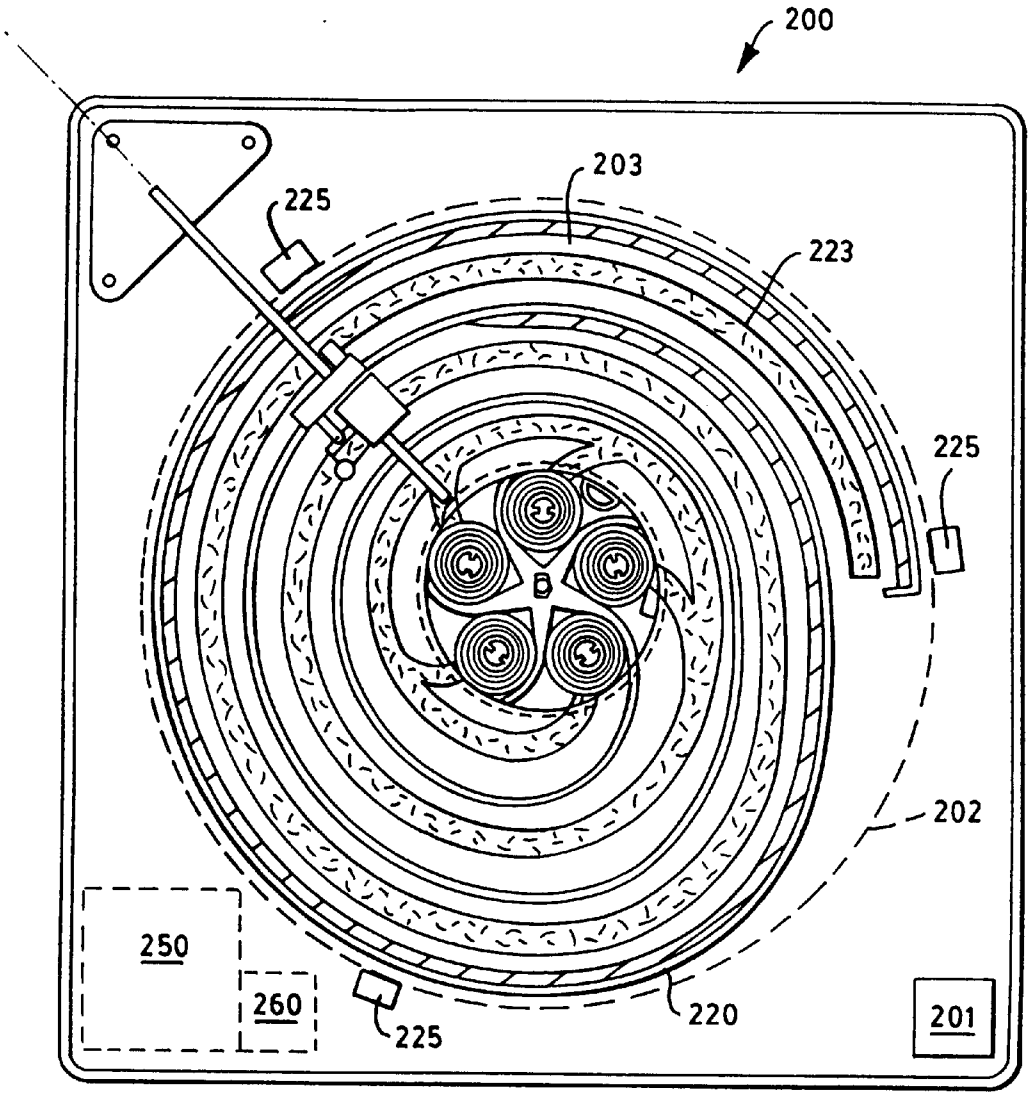
FIG. 12 is a top view of a second embodiment of a pad processing system, built in accordance with the principles of the invention.
Figure 13:
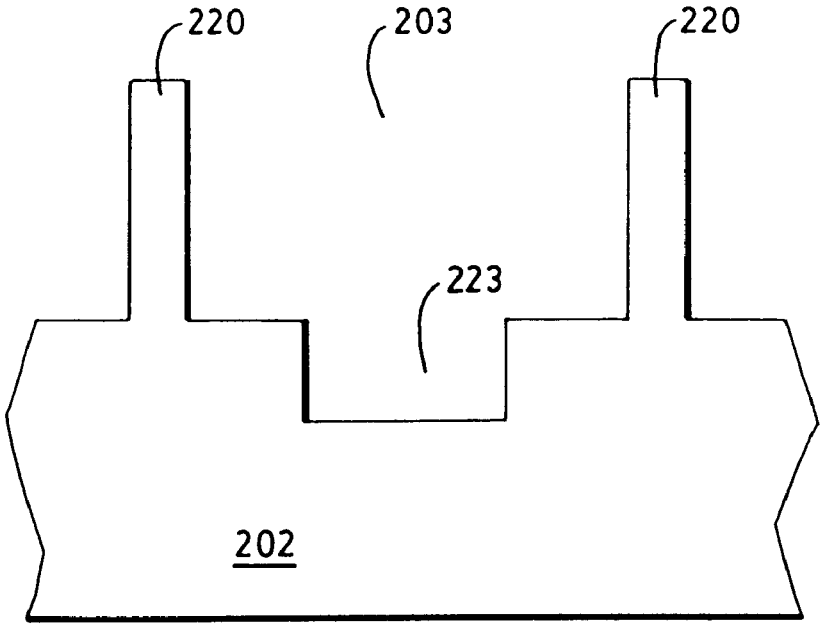
FIG. 13 is a side cross-sectional view of a portion of a turntable used in the pad processing system of FIG. 12.

The above example describes but one embodiment of a device for moving a selected spool, such as processing spool 80, to and from the spool caddy 1, and along the channel 203. An alternative spool retention and movement mechanism could be used which would retain both the top and the bottom ends of a spool such as exemplary processing spool 80. The spool core 72 located at the top end of the spool 80 could be retained as previously described (see FIG. 10D), and the bottom (i.e. opposite) end of the spool 80 could be retained by a mechanism (not shown) housed in the trench 223 of the turntable 202 (see FIGS. 12 and 13).

Figure 14:
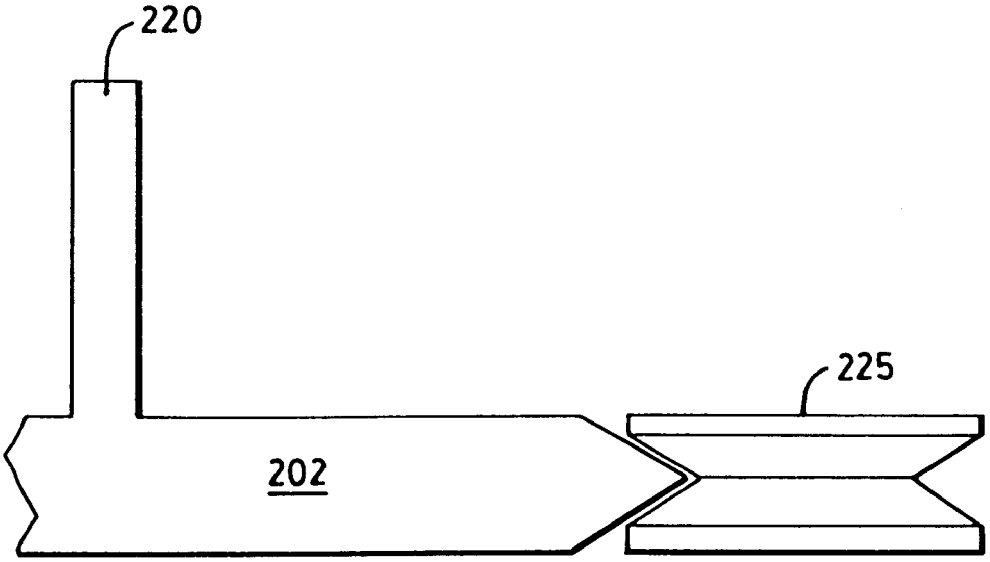
FIG. 14 is a side cross-sectional view of a portion of the turntable used in the pad processing system of FIG. 12 in cooperation with the turntable support and guiding structure.

A preferred structure for guiding and supporting the turntable 202 on the housing 206 of the pad processing system 200 includes triangularly located guide and roller support structures 225 (FIG. 12) which would cooperate with the turntable 202 as shown in FIG. 14.

Figure 11:
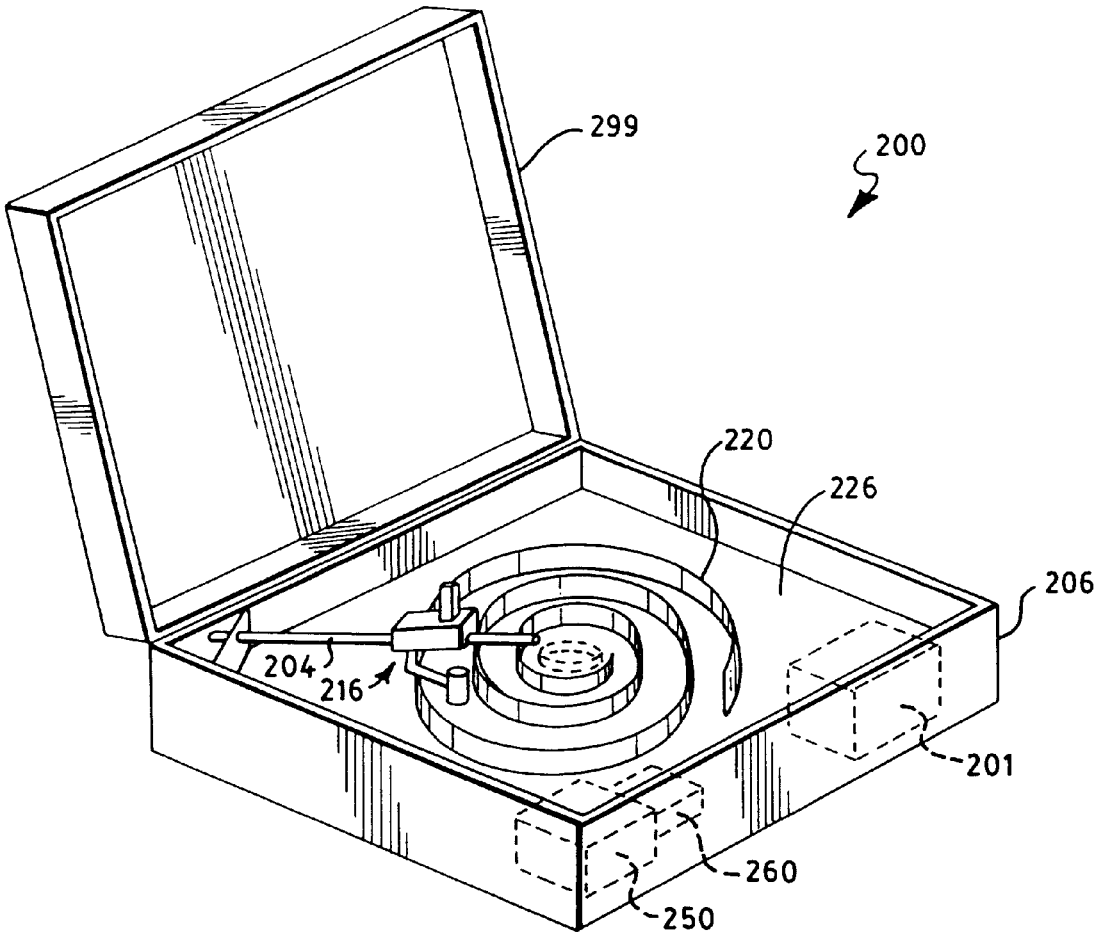
FIG. 11 is a perspective overview of the processing system of FIG. 1A.

The processing system 200 also requires a light-tight, heat-insulating cover 299 as shown in FIG. 11 so that when the cover is closed and the system 200 is activated, no light will enter the system. Furthermore, the heating unit 201 will heat and maintain the closed system 200 at preferably about 103 degrees Fahrenheit throughout processing by insulating both the housing 206 and the cover 299 and regulating, by use of a closed-loop control system (not shown), the temperature within the closed system 200.

Operation of the Pad Processing System

The operation of the pad processing system 200 will now be described in view of FIGS. 1A–1G for processing a film cartridge which houses 36 exposures. A system user first inserts an exposed film cartridge 70 into the spool caddy 1 in the manner previously described, then mounts the spool caddy 1 into the keyed recessed circular area 205 of the turntable 202 as shown in FIG. 1A so that the central longitudinal axis 16 of the spool caddy 1 aligns with the rotational axis 233 of the turntable 202. Note that the spool caddy 1 is illustrated without a snap plate 40 or 140 in FIGS. 1A–1G for easier viewing of the underlying processing spools. Of course in actual operation, the spool caddy 1 would be completely assembled as shown, for instance, in FIG. 3.

The spool retrieval mechanism 216 is initially located along the cantilever 204 as shown in FIG. 1A. The spool caddy 1 and the turntable 202 are keyed together so that when the turntable 202 is rotated, both the turntable 202 and the spool caddy 1 will have the same angular rotation rate about the axis 233. After the spool caddy 1 is securely positioned upon the turntable 202 as shown, the user then closes the light-tight cover 299 (see FIG. 11) and activates the system 200 by use of a control panel (not shown) to begin sequential operations described hereinafter under the control of the controller 260, such as a microprocessor.

Each spool or cartridge will be unwound along channel 203 as necessary for processing. A 12 exposure film cartridge will be unwound to point A, a 24 exposure film cartridge will be unwound to point B, and a 36 exposure cartridge will be unwound to point C. Each processing step will time out after an appropriate predetermined period of time. For instance, if the predetermined travel time of moving a spool or cartridge from the spool caddy 1 to point C is, say, 15 seconds, then each unwinding stage during the pad processing of a film cartridge would last for 15 seconds. If the 12 exposure film cartridge reaches point A and is completely unwound after 5 seconds, then the motor 250 will continue to run for another 10 seconds until it times out. Alternatively, the time outs could vary depending upon the operator selection for processing different length films.

After the user has inserted the spool caddy 1 and activated the system, the spindle retraction solenoid 268 is activated causing the spindle 276 of the spool retrieval mechanism 216 to retract into the spindle bore 282. The turntable 202 is rotated clockwise until the spool retrieval mechanism 216 is positioned in line with the blotter spool 110 as shown in FIG. 1B. At that point, the turntable 202 is momentarily halted and the screw drive motor 262 is activated in the forward direction to extend the front support block 252 of the spool retrieval mechanism 216 as previously discussed until it is positioned above the core 72 of the blotter spool 110 as shown in FIG. 1C. Then, the spindle retraction solenoid 268 is deactivated so that the head 278 of the spindle 276 drops into engagement with the tangs 74 of the blotter spool 110 in the same manner as illustrated in FIG. 10D where the spindle head 278 engages with the tangs 74 of a spool 80. After the spindle head 278 engages the tangs 74, the screw drive motor 262 is activated in the reverse direction until the front support block 252 is adjacent to the rear support block 258 and the blotter spool 110 is positioned in the channel 203. At this point in time, the spread roll solenoid 264 is deactivated, causing the spreading roller 210 to engage with the external side 222 of the wall 220 as previously discussed. Then, the turntable 202 is rotated counterclockwise until the blotter pad 11 of the blotter spool 110 is completely unwound and located adjacent to the end stop 227 at position C along the spiral wall 220. The spreading roller 210, when engaged, rolls the blotter pad 111 along the external surface 222 of the wall 220, resulting in an even spreading of the blotter pad 111. It is now desirable to park the blotter spool 110 at point C as shown in FIG. 1D so that the spool retrieval mechanism 216 can retrieve other spools from the spool caddy 1.

Figure 9D:
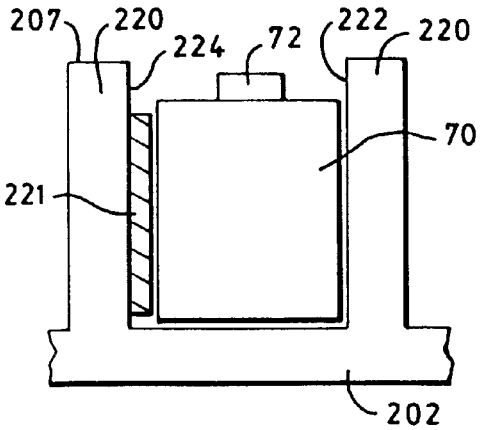
FIG. 9D is a cross-sectional side view of two adjacent spiral walls, including a braking mechanism, mounted on a turntable to form a channel through which a film cartridge is traveling during film processing.

A braking mechanism or means for holding a spool or cartridge at a fixed position along the channel 203 is shown in FIGS. 9B, 9C and 9D. FIG. 9A is a cross-sectional side view of the channel 203 defined by the turntable 202 and two adjacent sections of the spiral wall 220 having a width $D_6$. The channel 203 has a width $D_{13}$ and a height $D_{14}$. A brake pad 221 having a height $D_5$ and a thickness $D_{16}$ is adhesively bonded to the inner surface 224 of the wall 220 as shown in FIG. 9B. The brake pad 221, positioned a distance $D_{17}$ from the bottom surface 236 of the channel 203 and a distance $D_{15}$ from the top edge 207 of the wall 220, is preferably made of a resilient material such as foam rubber. FIG. 9C shows a processing spool 80 traveling through the channel 203 while engaging the brake pad 221. Specifically, the partially unwound processing spool 80 first engages the brake pad 221 at point A on the processor 200 (see FIG. 1A), so that approximately one-third of the web is unwound from the spool 80 as viewed in FIG. 9C. Note that the brake pad 221 is adhesively bonded to the inner surface 224 of the wall 220 whereas the web 82 of the developer spool 80 is being unwound onto the outer surface 222 of the wall 220. The upper and lower flanges 73 and 75, respectively, of the blotter spool 110 engage the brake pad 221 (as in FIG. 9C) so that the length $D_5$ of the brake pad 221 extends about midway into the width of each flange, and the thickness $D_{16}$ of the brake pad 221 is slightly less than the unwound section $D_1$ of the spool 80 as illustrated in FIG. 8B. The brake pad 221 is made of a material, such as foam rubber, which will compress as shown in FIG. 9C while engaged with the flanges 73 and 75 of the spool 80 and which will return to the shape shown in FIG. 9B when the spool 80 passes. Furthermore, the resilient forces of the brake pad 221 are designed to be adequate to hold the spool 80 in position along the channel 203 after the web 82 of the spool 80 has been completely unwound. FIG. 9D illustrates a film cartridge 70 engaged with the brake pad 221 so that the brake pad 221 is compressed against the wall 220, thereby creating a resilient force to hold the film cartridge 70 in place. As the film cartridge 70 passes through the channel 203, the brake pad 221 resiliently regains its original shape as shown in FIG. 9B. Of course, the brake pad 221 is but one embodiment of any means for holding a spool or cartridge at a fixed position along the channel 203.

Figure 1E:
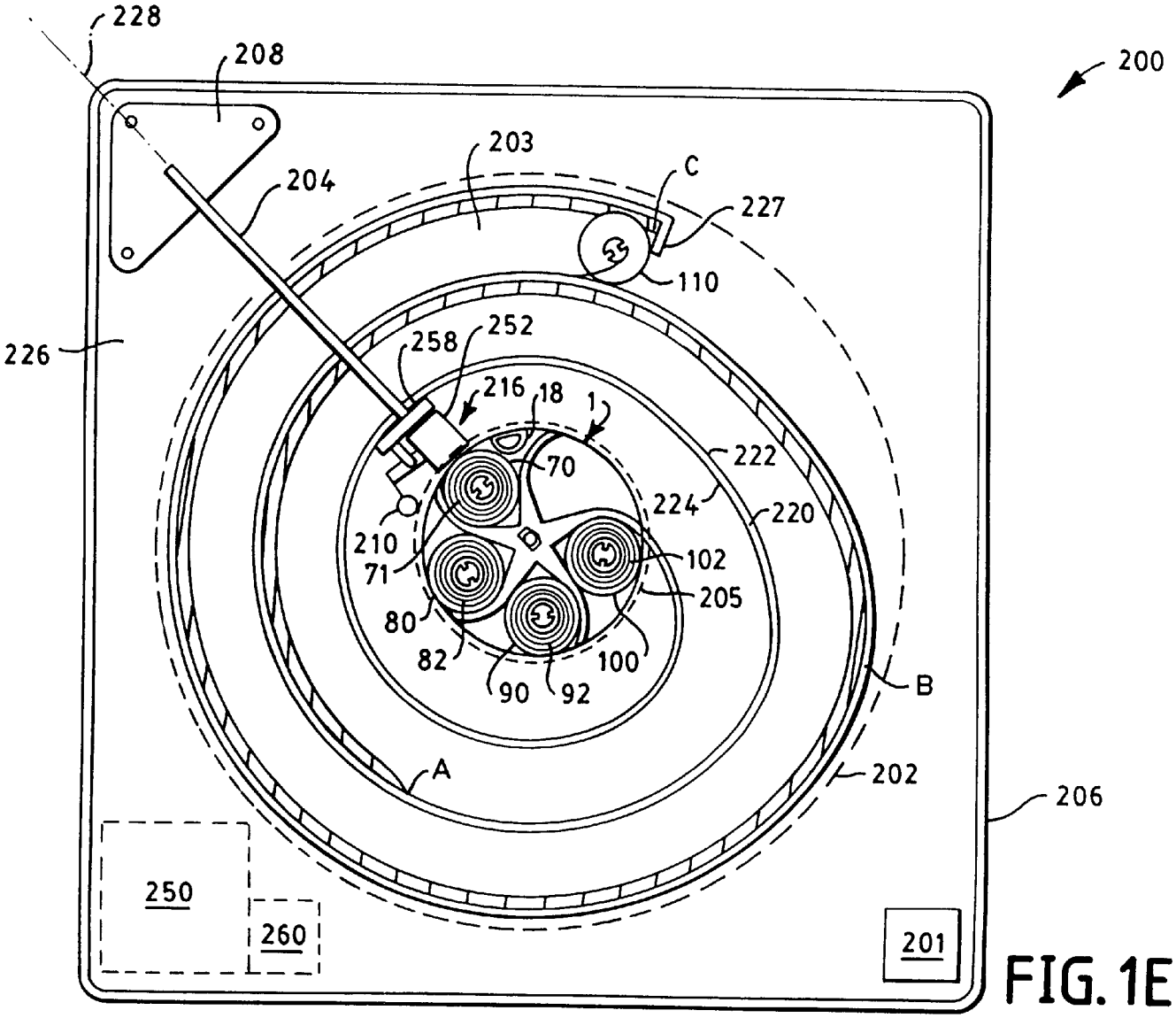

The spindle retraction solenoid 268 is activated, causing the spindle head 278 to withdraw from engagement with the tangs 74 of the core 72 of the blotter spool 110. The spindle head 278 is drawn into the bore 282 and the brake pad 221 secures the blotter spool 110 at point C in the channel 203. The spread roll solenoid 264 is activated, causing the spreading roller 210 to disengage from the wall 220. Then, the turntable 202 is rotated clockwise to move the spool retrieval mechanism 216 along the channel 203 and into alignment with the film cartridge 70 on the spool caddy 1 as shown in FIG. 1E. The turntable 202 is momentarily stopped and the screw drive motor 262 is activated in the forward direction to extend the front support block 252 until it is positioned directly above the film cartridge 70. Once the front support block 252 is properly positioned, the screw drive motor 262 is deactivated. The spindle retraction solenoid 268 is then deactivated, causing the spindle head 278 to drop into engagement with the tangs 74 of the film cartridge 70 as previously described. After the spindle head 278 engages the tangs 74, the screw drive motor 262 is activated in the reverse direction until the front support block 252 is adjacent to the rear support block 258 and the film cartridge 70 is positioned in the channel 203. Then, the turntable 202 is rotated counterclockwise until the film 71 is completely unwound so that an emulsion side faces away from the wall 220. It is now desirable to park the film cartridge 70 along the channel 203 so that the spool retrieval mechanism 216 can retrieve other spools from the spool caddy 1.

Figure 1F:
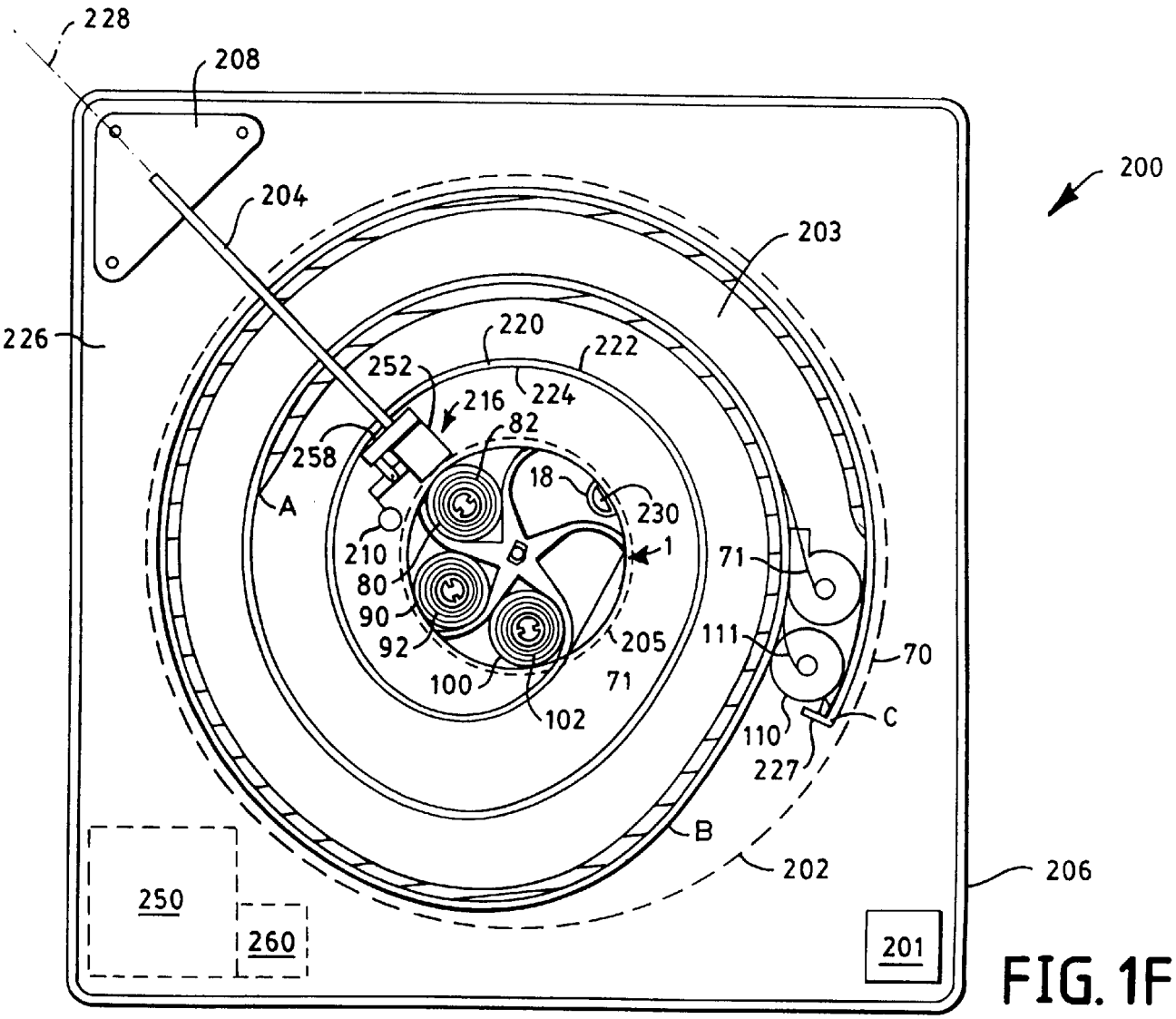

The spindle retraction solenoid 268 is activated, causing the spindle head 278 to withdraw from engagement with the tangs 74 of the core 72 of the film cartridge 70. The spindle head 278 is drawn into the spindle bore 282 and the brake pad 221 secures the film cartridge 70 adjacent to the blotter spool 110. Then, the turntable 202 is rotated clockwise to move the spool retrieval mechanism 216 into alignment with the developer spool 80 on the spool caddy 1 as shown in FIG. 1F. At this point in time, the turntable 202 is momentarily halted and the screw drive motor 262 is activated in the forward direction to extend the front support block 252 of the spool retrieval mechanism 216 until it is positioned above the core 72 of the developer spool 80. Then, the screw drive motor 262 is deactivated and the spindle retraction solenoid 268 is deactivated so that the head 278 of the spindle 276 drops into engagement with the tangs 74 of the developer spool 80. After the spindle head 278 engages the tangs 74, the screw drive motor 262 is activated in the reverse direction until the front support block 252 is adjacent to the rear support block 258 and the developer spool 80 is positioned in the channel 203. The spread roll solenoid 264 is deactivated, causing the spreading roller 210 to engage with the external side 222 of the wall 220 as previously discussed. Then, the turntable 202 is rotated counterclockwise so that the developer pad 82 is joined with the emulsion side of the film 71 along the external surface 222 of the wall 220. The engagement of the spreading roller 210 during unwinding results in an even spreading of chemicals imbibed within the developer pad 82.

After the developer spool 80 comes into contact with the film cartridge 70, the spool 80 will remain in that position for a preset developing dwell time during which the developing chemicals imbibed within the developer pad 82 interact with the emulsion side of the film 71 to develop latent images. The spool retrieval mechanism 216 can be moved along the spiral wall 220, if the spindle 276 is retracted, with the spreading roller 210 engaged throughout the developing dwell time. Although the spreading roller 210 can be moved in either direction along the wall 220, the preferred movement is unidirectional beginning at the center of the spiral wall 220. While the spool retrieval mechanism 216 is moving back and forth along the wall 220 to allow spreading of the developer chemicals by the spreading roller 210, the brake pad 221 secures the developer spool 80 in the channel 203 in the manner previously described.

Once the developing dwell time has expired, the spool retrieval mechanism 216 is repositioned above the developer spool 80 and the spindle retraction solenoid 268 is deactivated so that the head 278 of the spindle 276 drops into engagement with the tangs 74 of the developer spool 80. The spread roll solenoid 264 is activated so that the spreading roller 210 is disengaged from the developer pad 82. Then, the turntable 202 is rotated clockwise with the spool rewind motor 270 simultaneously activated, causing the developer pad 82 to rewind onto the developer spool 80 through the cooperative rotation of the spindle 276 and the turntable 202. When the developer pad 82 is rewound to the point where the developer spool 80 is positioned adjacent to its original position in the spool caddy 1, the turntable 202 is deactivated. The screw drive motor 262 is activated in the forward direction to extend the front support block 252 until the developer spool 80 is again positioned in its original position in the spool caddy 1. Then, the spool rewind motor 270 is deactivated. The screw drive motor 262 is then deactivated and the spindle retraction solenoid 268 is activated so that the head 278 of the spindle 276 is removed from engagement with the tangs 74 of the developer spool 80 and raised into the spindle bore 282. The screw drive motor 262 is then activated in the reverse direction, causing the front support block 252 to retract to the position adjacent to the rear support block 258. The screw drive motor 262 is then deactivated.

Figure 1G:
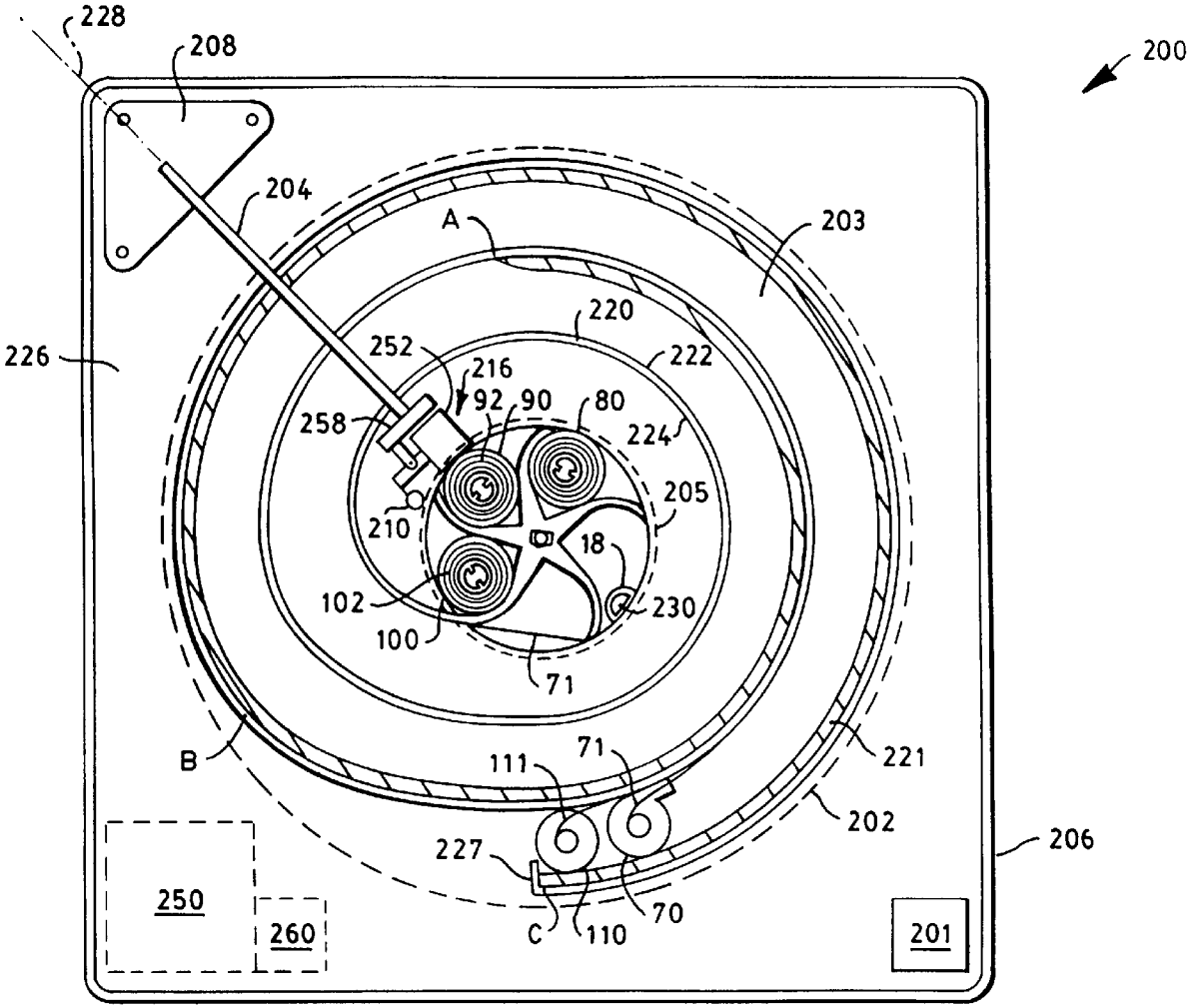

The turntable 202 is rotated clockwise until the spool retrieval mechanism 262 is aligned with the blix spool 90 as shown in FIG. 1G. The turntable 202 is momentarily halted and the screw drive motor 262 is again activated in the forward direction to extend the front support block 252 until it is positioned above the core 72 of the blix spool 90. The screw drive motor 262 is stopped and the spindle retraction solenoid 268 is deactivated so that the head 278 of the spindle 276 drops into engagement with the tangs 74 of the blix spool 90. After the spindle head 278 engages the tangs 74, the screw drive motor 262 is activated in the reverse direction until the front support block 252 is adjacent to the rear support block 258 and the blix spool 90 is positioned in the channel 203. The spread roll solenoid 264 is deactivated, causing the spreading roller 210 to engage with the external side 222 of the wall 220. Then, the turntable 202 is rotated counterclockwise until the blix spool 90 bumps into the film cartridge 70 along the channel 203 with the blix pad 92 completely unwound. The unwound blix pad 92 is combined with the emulsion side of the image carrying medium 71 so that the chemicals imbibed within the blix pad 92 will bleach and fix the film 71. Throughout a preset blix dwell time, the spool retrieval mechanism 216 with the spreading roller 210 engaged may be moved back and forth along the wall 220 with the spindle 276 retracted, as previously described, this time to evenly spread the bleaching and fixing chemicals imbibed within the blix pad 92.

When the blix dwell time expires, the spool retrieval mechanism 216 moves back through the channel 203 to a position directly above the blix spool 90. The above procedures are repeated for returning the blix spool 90 to the spool caddy 1, then retrieving and unwinding a washing and stabilizing web 102 from the washing and stabilizing spool 100 on the spool caddy 1. The unwound web 102 is combined with the emulsion side of the film 71 until the spool 100 bumps into the film cartridge 70 in the channel 203. During a washing and stabilizing dwell time, the spool retrieval mechanism 216 with the spreading roller 210 engaged and the spindle 276 retracted is moved back and forth through the channel 203, as previously described, to evenly spread the washing and stabilizing chemicals imbibed within the web 102. After the washing and stabilizing dwell time, the spool retrieval mechanism 216 is moved directly above the washing and stabilizing spool 100, the web 102 is rewound, and the washing and stabilizing spool 100 is returned to its original position on the spool caddy 1, as previously described.

The spool retrieval mechanism 216 retrieves and rewinds both the film cartridge 70 and the blotter spool 110 to the spool caddy 1. At this point in time, the processing of the film 71 within the film cartridge 70 is complete, and the system 200 shuts down. The user opens the cover 299 then removes and disposes of the spool caddy 1, including the spent processing spools, and retains the processed roll of film exposures 71, i.e. the negatives, stored on the film cartridge 70.

The principles enunciated above are applicable for processing any number of film exposures along the spiral shaped wall 220. Furthermore, the number of processing spools and corresponding processing steps, can be varied as necessary or desired.

It is to be understood that the above described embodiments are merely illustrative of the present invention of a photographic processing system having disposed within at least two spools having a processing web imbibed with a photographic processing material and capable of sequentially juxtaposing an emulsion side of a film from a film cartridge with one of the processing webs in a preset order, unwinding and rewinding each processing web from and to the corresponding spool, and unwinding and rewinding the film from and to the film cartridge and represent a limited number of the possible specific embodiments that can provide applications of the principles of the invention. Numerous and varied other arrangements may be readily devised in accordance with these principles by those skilled in the art without departing from the spirit and scope of the invention as claimed.

What is claimed is:

1. A light-tight, temperature controlled system, controlled by a controller, for processing a photographic film housed in a film cartridge detachably secured upon a spool caddy having a plurality of processing spools mounted thereon, said system comprising:

means for rotating a spiral shaped wall about a rotational axis, the spool caddy being detachably mounted upon said rotating means in a predetermined positional alignment;

means for combining an emulsion side of the film with processing webs from the processing spools along said spiral shaped wall for preset dwell times by sequentially in a preset order removing and replacing each of the processing spools and the film cartridge from and to the spool caddy, unwinding and rewinding said processing webs from and to the processing spools, and unwinding and rewinding the film from and to the film cartridge; and means for securing the processing spools and the film cartridge along a channel formed by said spiral shaped wall while said emulsion side of the film is being sequentially combined with said processing webs.

2. The system of claim 1, wherein said securing means further comprises securing the processing spools and the film cartridge along said channel formed by said spiral shaped wall while sequentially in said preset order removing and replacing each of the processing spools and the film cartridge from and to the spool caddy, unwinding and rewinding said processing webs from and to the processing spools, and unwinding and rewinding the film from and to the film cartridge.

3. A method for processing a photographic film housed in a film cartridge and detachably secured onto a spool caddy having a plurality of processing spools mounted thereon, said method comprising the steps of:

(A) providing a light-tight, temperature controlled enclosure for processing;

(B) mounting and keying the spool caddy onto a turntable in the enclosure, said turntable having a spiral shaped wall thereon;

(C) rotating said turntable about a rotational axis;

(D) sequentially removing and unwinding from, and replacing and rewinding to, the spool caddy each of the processing spools and the film cartridge, respectively, in a preset order so that the film is combined with processing webs from the processing spools along said spiral shaped wall for preset periods of time; and (E) securing unwound processing spools and the film cartridge along a channel formed by said spiral shaped wall during step (D).

4. A light-tight, temperature controlled system for processing a photographic film, housed in a film cartridge detachably secured upon a spool caddy having a plurality of processing spools mounted thereon, said system comprising:

a turntable mounted on a housing, said turntable having both a spiral shaped wall defining a channel and an interface for mounting the spool caddy in positional alignment thereon;

an overhead structure mounted on said housing and extending over said wall;

a spool retrieval mechanism mounted upon said overhead structure and movable along said overhead structure in cooperation with cam follower rollers engaged with said wall and mounted upon said spool retrieval mechanism, said spool retrieval mechanism including means for removing and replacing each of the processing spools and the film cartridge from and to the spool caddy, unwinding and rewinding processing webs from and to the processing spools, and unwinding and rewinding the film from and to the film cartridge;

a brake pad mounted upon said wall for securing the film cartridge and the processing spools during processing;

means for rotating said turntable upon said housing; and means for controlling said system.

5. The system of claim 4, wherein said spool retrieval mechanism further comprises:

means for engaging and disengaging a core of each of the processing spools and the film cartridge; and means for engaging and disengaging a spreading roller along said wall with each processing web passing therebetween so that chemicals imbibed within each said processing web are evenly spread.

6. A photographic processing system comprising:

means for disposing at least two spools having a processing web imbibed with a photographic processing material within the system;

means for sequentially juxtaposing an emulsion side of a film from a film cartridge with each of the processing webs in a preset order, unwinding and rewinding each processing web from and to the corresponding spool, and unwinding and rewinding the film from and to the film cartridge;

a spiral shaped wall disposed within the processing system; and means for securing the processing spools and the film cartridge along a channel formed by the spiral shaped wall while said emulsion side of the film is being sequentially combined with one of said processing webs.

* * * * *